US006943489B2

(12) United States Patent
Itoh et al.

(10) Patent No.: US 6,943,489 B2
(45) Date of Patent: Sep. 13, 2005

(54) HIGH RESOLUTION CRT DEVICE COMPRISING A COLD CATHODE ELECTRON GUN

(75) Inventors: Takashi Itoh, Amagasaki (JP); Masahide Yamauchi, Kyoto (JP); Koji Fujii, Kashihara (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/423,098

(22) Filed: Apr. 25, 2003

(65) Prior Publication Data

US 2003/0214218 A1 Nov. 20, 2003

(30) Foreign Application Priority Data

Apr. 25, 2002 (JP) ..... 2002-124878

(51) Int. Cl.[7] ..... H01J 1/46
(52) U.S. Cl. ..... 313/306; 313/309; 313/446
(58) Field of Search ..... 315/3, 3.5, 14; 313/306–307, 402, 408, 414, 461, 463, 446–449, 452, 309, 495

(56) References Cited

U.S. PATENT DOCUMENTS

| | | | | |
|---|---|---|---|---|
| 5,496,199 A | | 3/1996 | Makishima et al. | 445/4 |
| 5,747,922 A | * | 5/1998 | Sukeno et al. | 313/412 |
| 5,814,931 A | * | 9/1998 | Makishima | 313/441 |
| 6,236,156 B1 | * | 5/2001 | Ito | 313/495 |
| 6,310,438 B1 | * | 10/2001 | Tsuida et al. | 315/3.5 |
| 6,583,567 B2 | * | 6/2003 | Tsuida et al. | 315/3.5 |
| 6,756,734 B2 | * | 6/2004 | Tsuida et al. | 315/3 |

FOREIGN PATENT DOCUMENTS

| | | |
|---|---|---|
| JP | 6-223706 | 8/1994 |
| JP | 08-106848 | 4/1996 |
| JP | 09-204880 | 8/1997 |

* cited by examiner

*Primary Examiner*—Thuy Vinh Tran

(57) ABSTRACT

The CRT device comprises a cold cathode electron gun that includes cathodes, a peripheral focusing electrode, and an accelerating electrode. The cathode has a structure in which an emitter electrode and a gate electrode are joined together with an insulating layer interposed therebetween. The electric potential difference from the emitter electrode is 60V for the gate electrode, 0V for the peripheral focusing electrode, and 4.6 kV for the accelerating electrode.

33 Claims, 22 Drawing Sheets

| | |
|---|---|
| VOLTAGE Vex OF GATE ELECTRODE 100c | 60V |
| VOLTAGE Vf OF PERIPHERAL ELECTRODE 101 | 0V |
| VOLTAGE Vg2 OF ACCELERATING ELECTRODE 102 | 4.6kV |
| INITIAL SPEED OF ELECTRON BEAM | 60eV |
| DIVERGENCE ANGLE OF ELECTRON BEAM | -30° ~30° |

FIG.5

| | |
|---|---|
| VOLTAGE Vex OF GATE ELECTRODE 100c | 60V |
| VOLTAGE Vf OF PERIPHERAL ELECTRODE 101 | 0V |
| VOLTAGE Vg2 OF ACCELERATING ELECTRODE 102 | 4.6kV |
| INITIAL SPEED OF ELECTRON BEAM | 60eV |
| DIVERGENCE ANGLE OF ELECTRON BEAM | -30° ~30° |

70

A0

HIGH RESOLUTION CRT DEVICE COMPRISING A COLD CATHODE ELECTRON GUN

CROSS-REFERENCE TO RELATED APPLICATIONS

This application is based on application No. 2002-124878 filed in Japan, the contents of which are hereby incorporated by reference.

BACKGROUND OF THE INVENTION

1. Field of the Invention

The present invention relates to a CRT device comprising a cold cathode electron gun, particularly to a technique to improve resolution of the CRT device.

2. Description of the Related Art

In recent years, there has been development in CRT devices comprising an electron gun in which a cold cathode is applied instead of a thermal cathode. Since a cold cathode electron gun does not need a heater, the power consumption is small. Also, since the electron gun does not suffer from "doming" which is caused by heat, the possibility of having a deviation in positions of the electron beams is lower.

Although the cold cathode has such an advantage, it is difficult to converge the electron beam emitted from a field emitter array of a cold cathode electron gun, because the initial speed is high, and also the exit angle is large. Thus, the diameter of a spot formed on the phosphor screen of the CRT device (hereafter, referred to as "spot diameter") gets large, and high enough resolution is not yet achieved.

In order to cope with such a problem, proposed is a cathode ray tube that is disclosed in the Japanese Unexamined Patent Application Publication No. 8-106848, for instance. This cathode ray tube takes the aforementioned technical common sense into consideration, and improves resolution, with use of the dual gate method, by converging electron beams on the phosphor screen without forming a crossover point.

More specifically, the FEA (Field Emitter Array) according to the dual gate method comprised in such a cathode ray tube is a semiconductor element in which two gate electrodes are stacked up in the tube axis direction. An electron beam is emitted from an emitter electrode by an electric field formed by the first gate electrode provided closer to the emitter electrode, and an adjustment is made on the spot diameter by reducing the beam diameter of the electron beam with the electric field formed by the second gate electrode that has a lower voltage than the first gate electrode.

Such a cathode ray tube however presents a problem that the expected function cannot be rendered because the electric fields formed by those two gate electrodes influence each other, when the distance between the first gate electrode and the second gate electrode is short.

On the other hand, in order to make the distance between those two gate electrodes long, it is necessary to make the thickness of the insulating layer between the gate electrodes large; however, making the insulating layer thicker is difficult in terms of the semiconductor process technique, and the Field Emitter Array according to the dual gate method has low feasibility at the moment.

SUMMARY OF THE INVENTION

The object of the present invention, which has been made in view of the aforementioned problem, is to provide a CRT device that comprises a cold cathode electron gun and renders high resolution without using the dual gate method.

In order to achieve the object, the present invention provides a CRT device comprising: a cold cathode electron gun that includes (a) an emitter electrode from which electrons are emitted, (b) agate electrode that is disposed on a display screen side in a tube axis direction relative to the emitter electrode, and is operable to control the emission of the electrons from the emitter electrode, (c) a peripheral focusing electrode that is disposed on the display screen side in the tube axis direction relative to the emitter electrode, is thicker than the gate electrode, and surrounds the gate electrode, and (d) an accelerating electrode that is disposed on the display screen side in the tube axis direction relative to the peripheral focusing electrode; and a voltage applying unit operable to apply a voltage to each of the accelerating electrode, the gate electrode, and the peripheral focusing electrode, so as to form a crossover by making the voltage of the accelerating electrode higher than the voltages of the gate electrode and the peripheral focusing electrode.

With this arrangement, it is possible to inhibit divergence of the electron beams emitted from the field emitter array, and to reduce the crossover diameter, for instance; therefore, it is possible to reduce the spot diameter and obtain a high-resolution CRT. At the same time, it is possible to reduce manufacturing costs by reducing labor required for manufacturing of electron guns. Further, it is also possible to ensure the insulation between the gate electrode and the peripheral focusing electrode.

The CRT device of the present invention may have an arrangement wherein the cold cathode electron gun includes: a focusing electrode disposed on the display screen side in the tube axis direction relative to the accelerating electrode; and a final accelerating electrode disposed on the display screen side in the tube axis direction relative to the focusing electrode, and the voltage applying unit divides, with a resistor, a voltage applied to the final accelerating electrode, and applies the divided voltage to the accelerating electrode.

With this arrangement, it is possible to freely adjust the voltage applied to the accelerating electrode while maintaining a withstand voltage at a high enough level, when a high voltage is applied to the accelerating electrode.

The CRT device of the present invention may have an arrangement wherein the cold cathode electron gun includes: a focusing electrode disposed on the display screen side in the tube axis direction relative to the accelerating electrode; and a final accelerating electrode disposed on the display screen side in the tube axis direction relative to the focusing electrode, and the voltage applying unit applies a voltage that is applied to the focusing electrode also to the accelerating electrode.

With this arrangement, it is possible to apply a voltage to the accelerating electrode without using a resistor.

Further, the CRT device may have an arrangement wherein the peripheral focusing electrode is made up of at least (i) a first peripheral focusing electrode that has a substantially same thickness as the gate electrode, is substantially aligned with the gate electrode with respect to positions in the tube axis direction, and surrounds the gate electrode, and (ii) a second peripheral focusing electrode that is disposed on the display screen side in the tube axis direction relative to the first peripheral focusing electrode.

With this arrangement, it is possible to further reduce manufacturing costs of the electron guns.

Further the CRT device may have an arrangement wherein an inside diameter of the first peripheral focusing electrode is smaller than an inside diameter of the second peripheral focusing electrode. In the present application, an inside diameter of an electrode, such as a planar peripheral focusing electrode or a three dimensional peripheral focusing electrode, denotes a diameter that defines a through hole which each of the electrodes has for allowing an electron beam to pass through.

The CRT device of the present invention may have an arrangement wherein the first peripheral focusing electrode has a lower voltage than the second peripheral focusing electrode.

With this arrangement, it is possible to give a strong focusing action to the electron beam in the vicinity of the cathode, immediately after the exit.

The CRT device of the present invention may have an arrangement wherein an inside diameter of the peripheral focusing electrode increases towards the accelerating electrode.

With this arrangement, it is possible to prevent the electron beams from colliding with the peripheral focusing electrode.

Further, with an arrangement wherein an internal wall of the peripheral focusing electrode is parallel to a central axis of the peripheral focusing electrode in a vicinity of the gate electrode, it is possible to maintain the focusing action onto the electron beams, and enlarge the inside diameter.

It is also acceptable to have an arrangement wherein an inside diameter of the second peripheral focusing electrode increases towards the accelerating electrode, or an arrangement wherein an internal wall of the second peripheral focusing electrode is parallel to a central axis of the second peripheral focusing electrode in a vicinity of the gate electrode.

With these arrangements, it is possible to have the aforementioned effects even when the peripheral focusing electrode is divided into a planar peripheral focusing electrode and a three dimensional peripheral focusing electrode.

It is also acceptable to have: an arrangement wherein the accelerating electrode is chamfered on a peripheral focusing electrode side thereof; an arrangement wherein the accelerating electrode is radiused at its periphery on a peripheral focusing electrode side thereof; an arrangement wherein the peripheral focusing electrode is chamfered on an accelerating electrode side thereof; or an arrangement wherein the peripheral focusing electrode is radiused at its periphery on an accelerating electrode side thereof.

With these arrangements, it is possible to prevent an electric discharge that may be generated between the electrodes due to a large electric potential difference between the peripheral focusing electrode and the accelerating electrode.

The CRT device of the present invention may further have an arrangement wherein an inside diameter of the accelerating electrode is no greater than an inside diameter of the peripheral focusing electrode.

With this arrangement, it is possible to strengthen the electric field lens formed by the gate electrode, the peripheral focusing electrode, and the accelerating electrode, and therefore strengthen the focusing action onto the electron beams and inhibit divergence of the electron beams.

The CRT device of the present invention may further have an arrangement wherein the cold cathode electron gun includes: a focusing electrode disposed on the display screen side in the tube axis direction relative to the accelerating electrode; and an additional focusing electrode that is provided between the accelerating electrode and the focusing electrode, and has a lower voltage than the accelerating electrode.

The CRT device of the present invention may further have an arrangement wherein an additional focusing electrode that is provided between the accelerating electrode and the focusing electrode, and has a lower voltage than the accelerating electrode.

With this arrangement, it is possible to form an additional focusing lens with use of the influence of the electric field formed by an additional focusing electrode, and adjust the divergence angle of the electron beam by the additional focusing lens so that the electron beam enters the main lens at a preferable angle. Consequently, it is possible to reduce the spot diameter and improve the resolution.

The present invention may have an arrangement wherein an inside diameter of the second peripheral focusing electrode decreases towards the accelerating electrode.

With this arrangement, it is possible to further enhance the focusing action that the electron beams receive from the peripheral focusing electrode.

The present invention also provides a CRT device comprising: a cold cathode electron gun that includes (a) a gate electrode, (b) a peripheral focusing electrode that is thicker than the gate electrode and surrounds the gate electrode, (c) an emitter electrode that has a plurality of protrusions from each of which electrons are emitted, each protrusion being at least a predetermined distance apart from the peripheral focusing electrode, and (d) an accelerating electrode; and a voltage applying unit operable to apply voltages so as to form a crossover by making the voltage of the accelerating electrode higher than the voltages of the gate electrode and the peripheral focusing electrode.

With this arrangement, it is possible to prevent a high-order aberration caused by variation between the emitter electrode and the peripheral focusing electrode, and to render high resolution.

In this case, it is especially effective with an arrangement wherein each of the protrusions is at least 0.01 mm apart from the peripheral focusing electrode.

Further, the CRT device of the present invention may have an arrangement wherein the plurality of protrusions are disposed in a rectangular area in a plan view.

Furthermore, the CRT device of the present invention may have an arrangement wherein the emitter electrode is made up of at least three partial electrodes that are positioned adjacent to one another in a horizontal direction, electrons are emitted from all the three partial electrodes, when a central area of a display screen is scanned, and electrons are emitted from only one of the three partial electrodes that is positioned centrally in the horizontal direction, when an area of the display screen except for the central area thereof is scanned.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings:

FIG. 5 shows the conditions in the simulations for the performance evaluation of the electron gun 10;

DESCRIPTION OF THE PREFERRED EMBODIMENTS

The following describes the preferred embodiments of the CRT device of the present invention with reference to the drawings.

1. First Embodiment 1-1. General Structure

Figure 1:
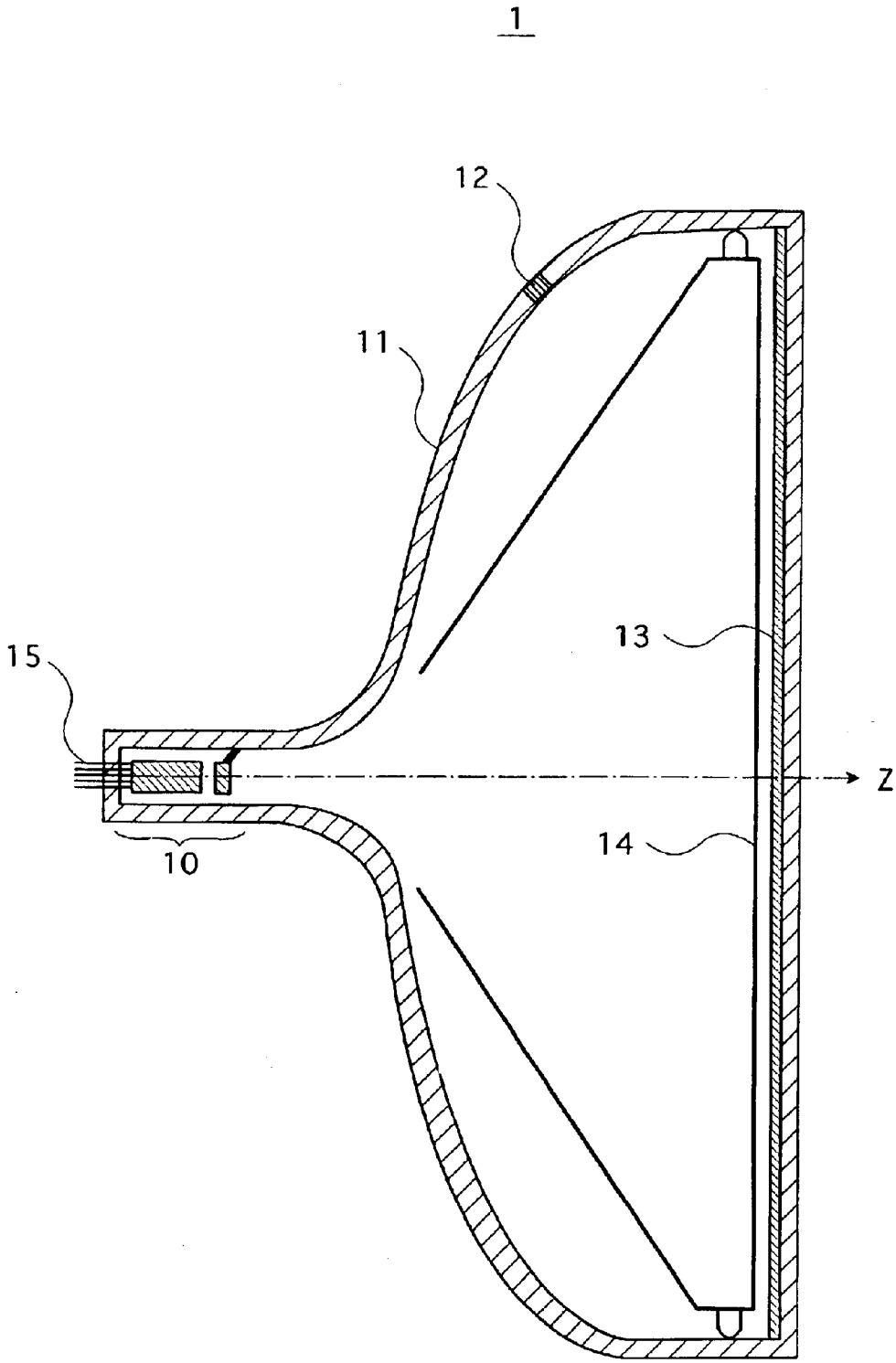
FIG. 1 shows the longitudinal sectional view including the tube axis Z of the color CRT device of the first embodiment.

FIG. 1 shows the longitudinal sectional view including the tube axis Z of the CRT device of the first embodiment. As shown in FIG. 1, the CRT device 1 comprises a glass bulb 11. Inside of the screen face of the glass bulb 11 is a phosphor screen 13 on which a phosphorous substance is applied. Also, provided inside of the glass bulb 11 is a shadow mask 14 which is opposing the phosphor screen 13.

An anode button 12 is provided at the funnel part of the glass bulb 11. Inserted at the inside of the neck part of the glass bulb 11 is a cold cathode electron gun (hereafter, simply referred to as "the electron gun") 10.

Protruding from the end of the neck part are electrode terminals 15 coming out of the stem of the electron gun 10. Various kinds of signals are inputted into the electron gun 10 through the electrode terminals 15. A voltage is applied from the anode button 12 to the electron gun 10, via the inner wall of the glass bulb 11.

1-2. Structure of the Electron Gun 10

Figure 2:
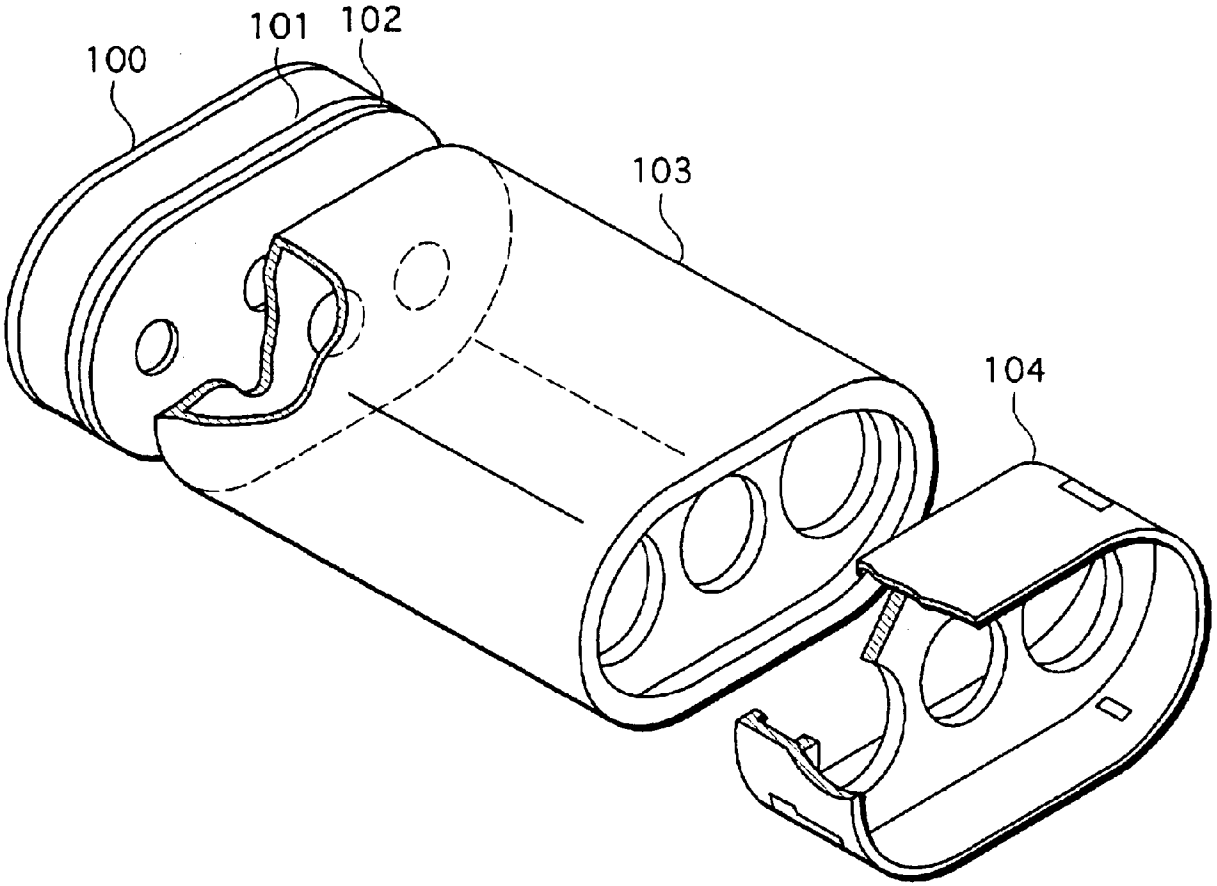
FIG. 2 is a perspective view of the exterior to show the general appearance of the electron gun 10.

FIG. 2 is a perspective view of the exterior to show the general appearance of the electron gun 10. The electron gun 10 comprises cathodes 100 in the colors of R, G, and B, a peripheral focusing electrode 101, and an accelerating electrode 102. Starting from the cathode's side, these electrodes are arranged in the order of the cathodes 100, the peripheral focusing electrode 101, the accelerating electrode 102, a focusing electrode 103, and a final accelerating electrode 104.

The cathodes 100 emit three electron beams with different current amounts corresponding to the luminance of each of the colors of R, G, and B. The peripheral focusing electrode 101 make the electron beams emitted from the cathodes converge, by forming electric field lens. The accelerating electrode 102 inhibits divergence of the electron beams.

The focusing electrode 103 and the final accelerating electrode 104 form what is called a main lens (an electric field lens). In the present embodiment, a voltage of about 5 kV to 8 kV is applied to the focusing electrode 103, and a voltage of about 25 kV to 35 kV is applied, via the anode button 12, to the final accelerating electrode 104.

Voltages are applied to the cathode 100, the peripheral focusing electrode 101, the accelerating electrode 102 and the focusing electrode 103, via the stem of the electron gun 10.

Figure 3:
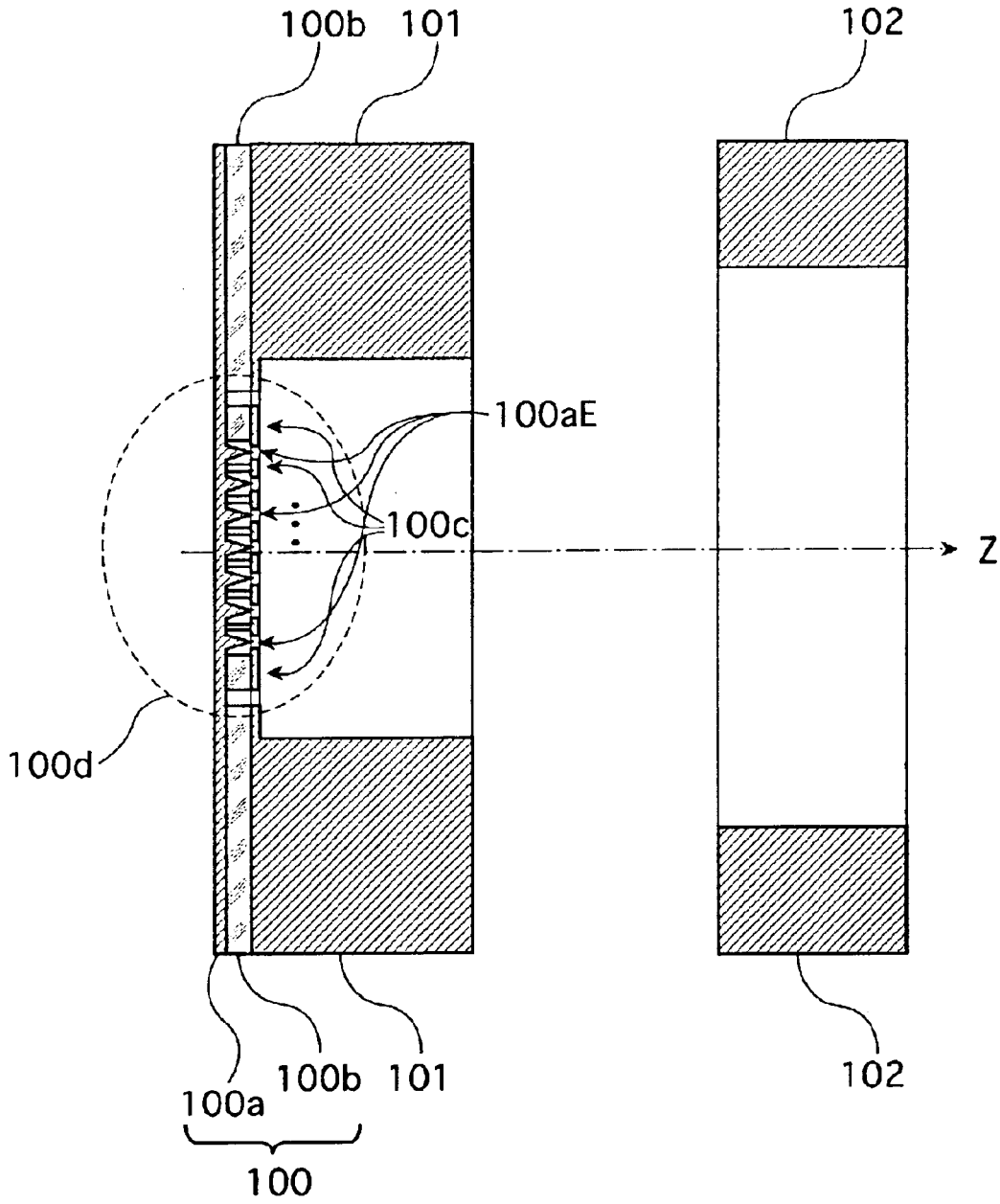
FIG. 3 is a longitudinal sectional view including the tube axis Z, showing the cathode 100, the peripheral focusing electrode 101, and the accelerating electrode 102 of the electron gun 10.

FIG. 3 is a longitudinal sectional view including the tube axis Z, showing the cathode 100, the peripheral focusing electrode 101, and the accelerating electrode 102 of the electron gun 10. FIG. 3 shows the part that emits an electron beam for the color of Green among the three primary colors of R, G, and B.

For each of the other primary colors of R and B, with regard to the part that emits an electron beam corresponding to each color, the longitudinal sectional view including the central axis of the electron beam would be the same as FIG. 3; therefore, explanation will be provided on the case of the primary color G as a representative example.

As shown in FIG. 3, the cathode 100 is structured with an emitter electrode 100*a* that emits electrons, a gate electrode 100*c* that controls the field emission, and an insulating layer 100*b* that is interposed between them. The peripheral focusing electrode 101 is disposed around the gate electrode 100*c*.

The accelerating electrode 102 is disposed opposing, in the tube axis direction, the peripheral focusing electrode 101. The emitter electrode 100*a* has a plurality of protrusions 100*a*E. Of the cathode 100, the part that has the protrusions 100*a*E will be referred to as a field emitter array 100*d*.

Figure 4:
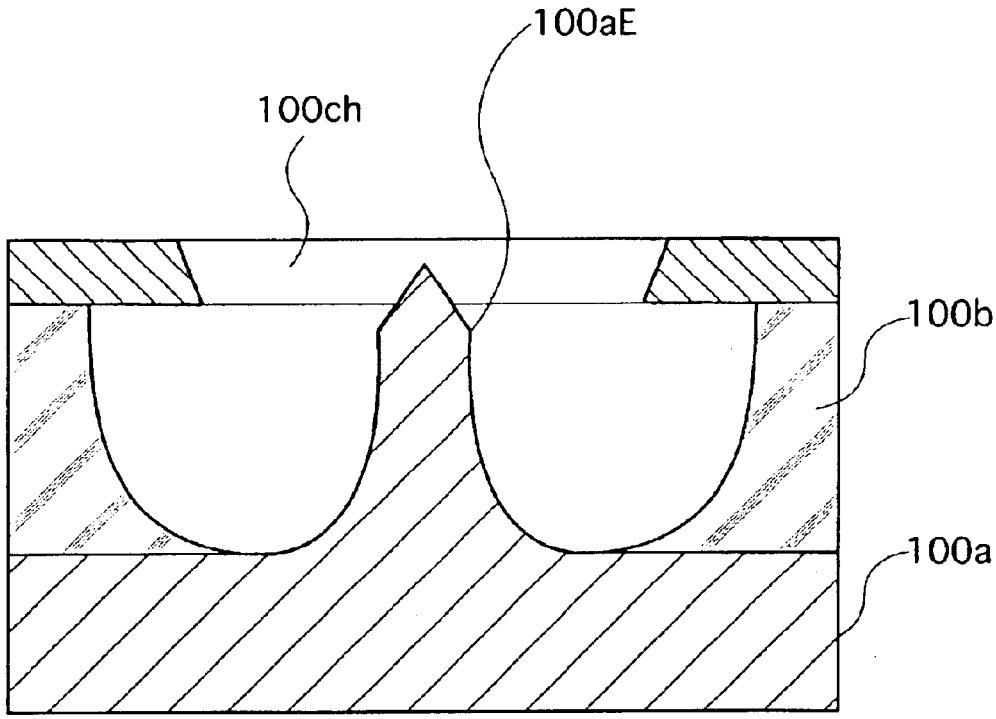
FIG. 4 is a close-up perspective sectional view of one of the protrusions 100*a*E of the emitter electrode 100*a* in the field emitter array 100*d;*

FIG. 4 is a partial sectional view of one of the protrusions 100*a*E of the emitter electrode 100*a* in the field emitter array 100*d*. As shown in FIG. 4, the gate electrode 100*c* has a gate hole 100*ch* that surrounds the tip of the protrusion 100*a*E which is projecting.

By making an electric potential difference, which corresponds to a luminance signal, between the emitter electrode 100*a* and the gate electrode 100*c*, the field emitter array 100*d* forms a strong electric field near the tip of the protrusion 100*a*E of the emitter electrode 100*a*, and causes an electron beam to be emitted from the tip of the protrusion 100*a*E. The electron beam has an initial speed within a range of tens of eV to 100 eV depending on the electric potential difference between the emitter electrode 100*a* and the gate electrode 100*c*.

It should be noted that when protrusions 100*a*E are formed on the emitter electrode 100*a* in the semiconductor manufacturing process, other small protrusions get formed on the surface of the emitter electrode 100*a* in addition to the protrusions 100*a*E.

When an electron beam is emitted from the protrusion 100*a*E, electrons are also emitted from each of the tips of those small protrusions. Thus, the electron emitted from the protrusion 100*a*E has an angle of a certain number of degrees with respect to the central axis extending in the direction of the height of the protrusion 100*a*E.

This angle is normally called a divergence angle. The divergence angle varies depending on the shape of the cold cathode or a voltage applied, but it is usually around 30 degrees. The cold cathode in the present embodiment also has a similar divergence angle. Just for information, a divergence angle of a thermal cathode is known to be around 90 degrees normally.

Accordingly, the electron beams emitted from a cold cathode diverge due to the high initial speed, even though the divergence angle is smaller than the electron beams emitted from a thermal cathode. Thus, it has been conventionally considered that forming a crossover is difficult.

In FIG. 3, (i) the electric potential difference (gate voltage) Vex between the emitter electrode 100*a* and the gate electrode 100*c*, (ii) the voltage difference Vf between the electric potentials of the emitter electrode 100*a* and the peripheral focusing electrode 101, and (iii) the voltage Vg2 between the emitter electrode 100*a* and the accelerating electrode 102 satisfy the following formula:

$$Vf<Vex<<Vg2$$

As above, the peripheral focusing electrode 101 has a lower electric potential than the gate electrode 100*c*; therefore, the electron beams emitted from the field emitter array 100*d* are influenced by a strong focusing action.

In addition to such a focusing action, the electron beams are also influenced by a strong focusing action caused by an electric field lens having a small curvature which is formed in the vicinity of the emitter electrode 100*a* by the gate electrode 100*c*, the peripheral electrode 101, and the accelerating electrode 102.

Further, at the electron gun 10, the divergence of the electron beams is inhibited by strengthening the focusing action through making the electric potential difference between the emitter electrode 100*a* and the accelerating electrode 102 larger, and enhancing the strength of the electric field with respect to the tube axis direction.

As so far explained, the electron gun 10 is able to form a crossover and also make the crossover diameter smaller than the electron emission diameter of the field emitter array 100*d*, for instance; therefore, the electron gun is eventually able to reduce the spot diameter and improve the resolution of the CRT device.

For information, the spot diameter is known to vary depending on (a) the product of the object point diameter and the magnification of the main lens, (b) the aberration of the main lens, and (c) the Coulomb repulsion between the electrons in the electron beams. The object point diameter denotes a crossover diameter with regard to this invention, and denotes the diameter of the part of the field emitter array that emits electrons with regard to the prior art mentioned above.

Additionally, the magnification of the main lens is proportional to (d) the divergence angle of the electron beams that have exited the crossover, and (e) the square root of the electric potential difference between the crossover and the emitter electrode. Accordingly, for example, when the electric potential of the accelerating electrode 102 is high as mentioned above, it is possible to reduce the crossover diameter in the item (a) above, and also reduce the divergence angle in the item (d) above, and the spot diameter therefore can be reduced.

Further, even when the crossover diameter is not reduced, it is possible to reduce the spot diameter by only reducing the divergence angle.

For example, in consideration of the repulsion between the electron beams, it is considered that reducing the crossover diameter makes the repulsion larger. Consequently, it is possible to reduce the spot diameter while inhibiting the influence of the repulsion, by reducing only the divergence angle without reducing the crossover diameter.

1-3. Results of Simulations

Performance evaluations have been made by doing simulations on the electron gun 10. FIG. 5 shows the conditions in the simulations for the performance evaluation. As for the divergence angle of the electron beams, the orbits of electrons are found for every 15 degrees within the range shown in the table.

Figure 6:
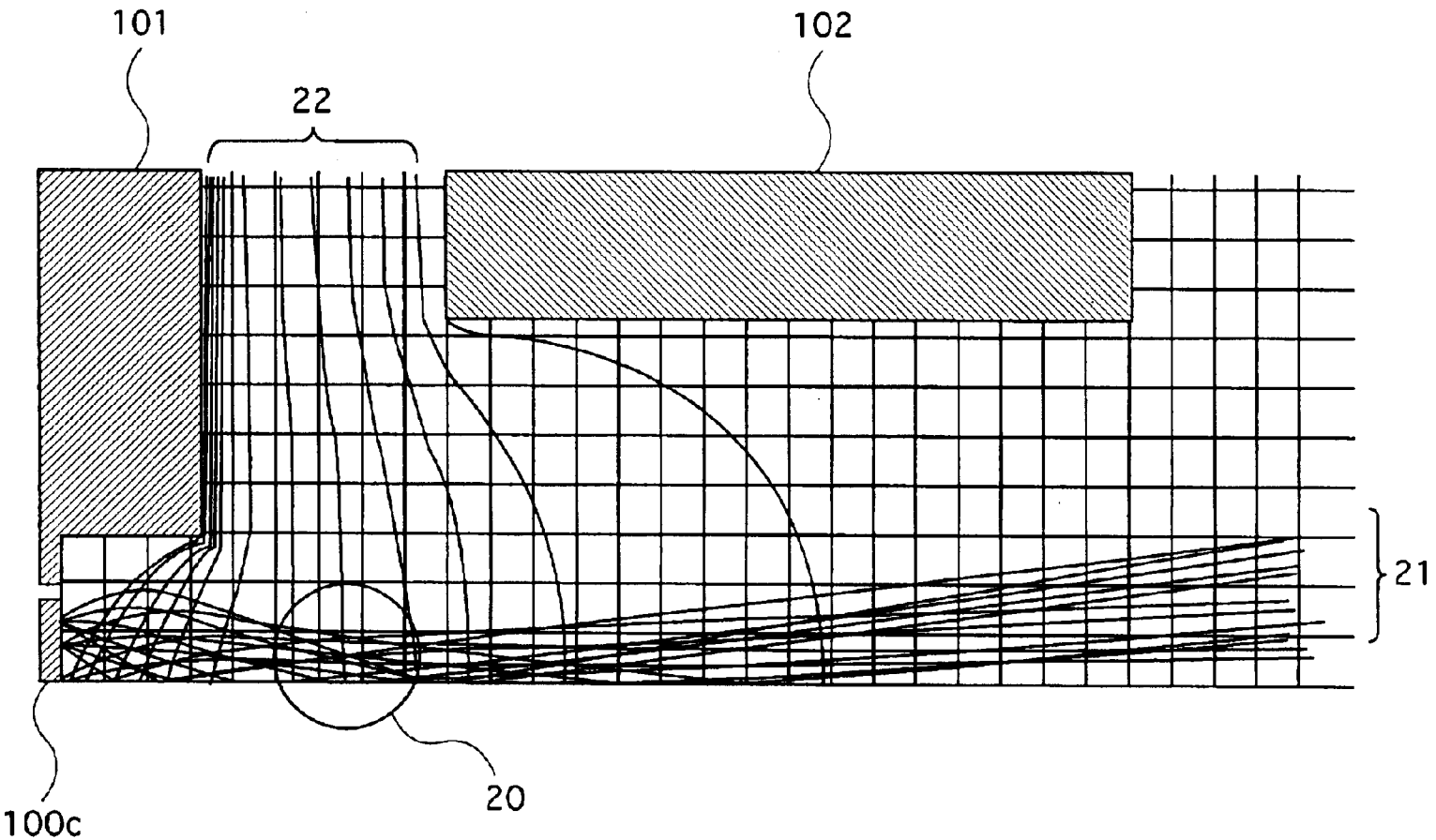
FIG. 6 shows the orbits of the electrons and the equipotential lines of the electron gun 10 found in the simulations above.

FIG. 6 shows the orbits of the electrons and the equipotential lines found in the simulations above. As shown in FIG. 6, an electric field is formed by the peripheral focusing electrode 101 and the accelerating electrode 102 as shown with the equipotential lines 22.

Under the influence of such an electric field, the electron beam 21 emitted from the field emitter array forms a crossover 20 immediately outside of the space surrounded by the peripheral focusing electrode 101. The crossover 20 has a smaller diameter than the electron emission diameter of the field emitter array.

After forming the crossover 20, the electron beam 21 enters the main lens while enlarging the diameter, and forms an image of the crossover 20 on the phosphor screen 13 by the focusing action of the main lens. This way, the CRT device of the present embodiment renders high resolution by reducing the crossover diameter.

1-4. Modification Example of the First Embodiment

The following modifications are possible as to the CRT device of the first embodiment:

(1) In the aforementioned example, the peripheral focusing electrode 101 as a whole is integrally formed; however, it is also acceptable to arrange it as follows instead.

Figure 7:
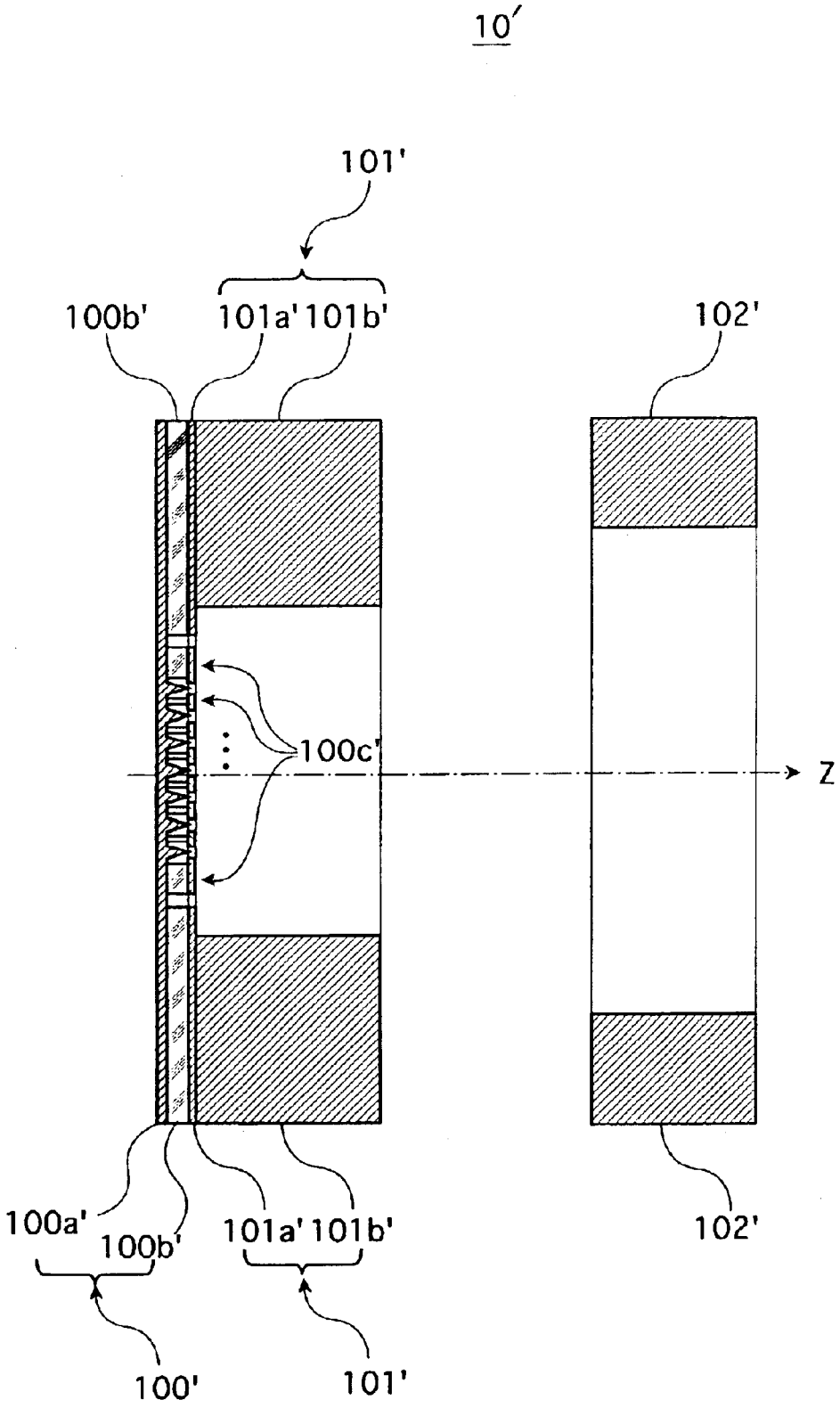
FIG. 7 is a longitudinal sectional view including the tube axis Z of the electron gun comprised in the CRT device of the modification example (1) of the first embodiment, particularly showing the structure around the vicinity of the peripheral focusing electrode.

FIG. 7 is a longitudinal sectional view including the tube axis Z of the electron gun comprised in the CRT device of the present modification, showing the structure around the vicinity of the peripheral focusing electrode.

As shown in FIG. 7, the electron gun 10' has a substantially same structure as the aforementioned electron gun 10, and comprises a cathode 100', in which an emitter electrode 100*a*', and a gate electrode 100*c*' are joined by an insulating layer 100*b*', a peripheral focusing electrode 101', and accelerating electrode 102'.

The electron gun 10' differs from the electron gun 10 in that the peripheral focusing electrode 101' is divided into a planar peripheral focusing electrode 101*a*' and a three dimensional peripheral focusing electrode 101*b*'. The planar peripheral focusing electrode 101*a*' is on the substantially same plane as the gate electrode 100*c*'. The planer peripheral focusing electrode 101*a*', together with the three dimensional peripheral focusing electrode 101*b*', forms the substantially same shape as the peripheral focusing electrode 101 above.

With this arrangement, it is possible to manufacture the electron gun of the present embodiment more easily, because the three dimensional peripheral focusing electrode 101*b*', which is separately manufactured, can be joined after the emitter electrode 100*a*', the insulating layer 100*b*', the gate electrode 100*c*' and the planer peripheral focusing electrode 101*a*' are all formed through a semiconductor manufacturing process.

In this modification example, the inside diameter of the planar peripheral focusing electrode 101*a*' is smaller than the three dimensional peripheral focusing electrode 101*b*', as shown in FIG. 7. This way, even if there is a deviation of the position when the three dimensional peripheral focusing electrode 101*b*' is joined with the planar peripheral focusing electrode 101*a*', there is no possibility that the three dimensional peripheral focusing electrode 101*b*' protrudes over the opening of the planar peripheral focusing electrode 101*a*', Consequently, it is possible to prevent the three dimensional peripheral focusing electrode 101*b*' from contacting the gate electrode 100*c*', or prevent an emission fault due to, for example, a short circuit between these electrodes; therefore, it is possible to reduce costs by reducing manufacturing faults and supply good products at low prices.

Further, in a case where there is no possibility of having a deviation of the position in the manufacturing process, or where the position deviation can be controlled within a tolerable range for the product quality, it is acceptable that the inside diameter of the planar peripheral focusing electrode 101*a*' is substantially the same as the inside diameter of the three dimensional peripheral focusing electrode 101*b*', needless to say.

Furthermore, the following arrangement is also possible for applying a voltage to the gate electrode 100*c*' at this time: It is possible to provide a lead wire between the planar peripheral focusing electrode 101*a*' and the three dimensional peripheral focusing electrode 101*b*', supply a voltage to the gate electrode 100*c*' via the lead wire.

FIG. 8 shows (a) a plan view of the peripheral focusing electrode etc., and (b) the A—A cross section of the plan view (a), illustrating the case where a voltage is supplied to the gate electrode 100*c*' via the lead wire provided between the planar peripheral focusing electrode 101*a*' and the three dimensional peripheral focusing electrode 101*b*'.

Figure 8A:
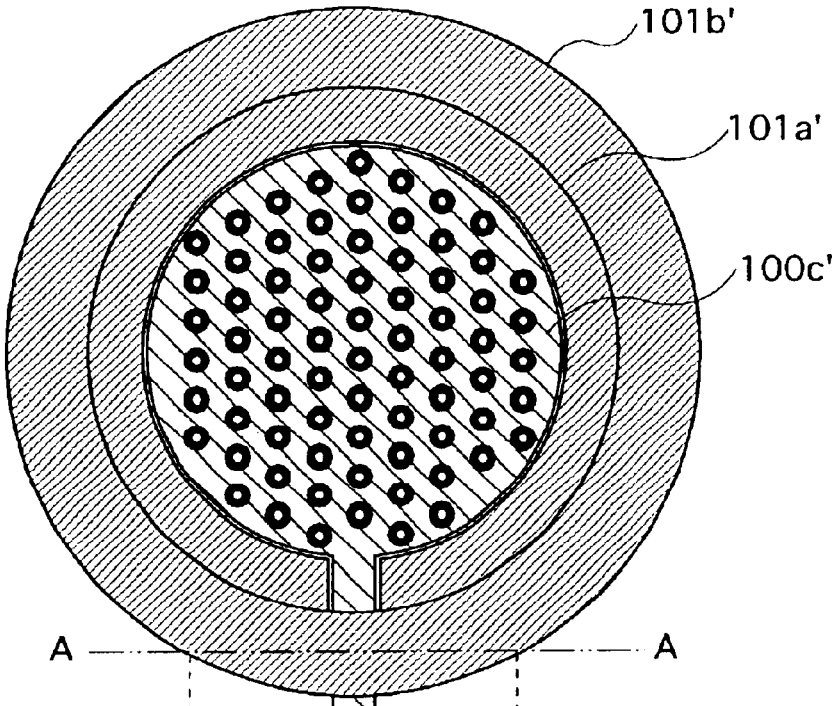
FIG. 8 shows (a) a plan view of the peripheral focusing electrode etc., and (b) the A—A cross section of the plan view (a), illustrating the case where a voltage is supplied to the gate electrode 100*c*' via the lead wire provided between the planar peripheral focusing electrode 101*a*' and the three dimensional peripheral focusing electrode 101*b';*
Figure 8B:
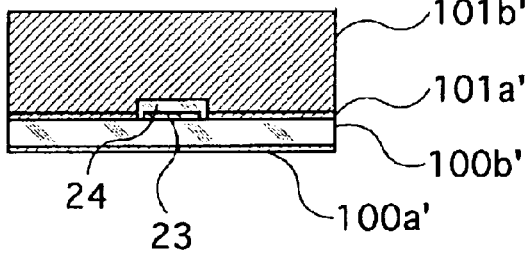

As shown in FIG. 8A, the lead wire 23 leads out of the gate electrode 100*c*'. As shown in FIG. 8B, the lead wire 23 is covered by the insulating layer 24. Alternatively, the insulating layer 24 may merely be a space.

A groove is provided on a surface of the three dimensional peripheral focusing electrode 101*b*' that opposes the planar peripheral focusing electrode 101*a*', and the lead wire 23 is disposed so as to go along the groove.

Further, it is also acceptable that a voltage is applied to the planar peripheral focusing electrode 101*a*' via the three dimensional peripheral focusing electrode 101*b*'. It is also acceptable that a voltage is applied to the planar peripheral focusing electrode 101*a*' via a lead wire that leads out thereof.

(2) In the first embodiment, there is only one peripheral focusing electrode 101 in the electron gun 10 as a whole. It is also acceptable to arrange it alternatively so that a peripheral focusing electrode 101 is provided for each color of RGB.

(3) In the first embodiment, the voltage Vg2 of the accelerating electrode 102 (the electric potential difference between the emitter electrode 100*a* and the accelerating electrode 102) is arranged to be 4.6 kV; however, according to simulations under various conditions, it has been confirmed that the object of the present invention, which is to reduce the crossover diameter and render high resolution, can be achieved when the voltage Vg2 is 1 kV, for instance.

(4) In the first embodiment, explanation was provided on a case where the present invention is applied to a color CRT device; however, needless to say, the present invention is not limited to this, the present invention may be applied to a CRT device other than a color CRT device. It is possible to apply the present invention whether the CRT device is for color images or not, and have the advantageous effects.

1-5. Supplemental Information for the Effects of the First Embodiment

According to the first embodiment, it is possible to reduce manufacturing costs by omitting labor required for manufacturing electron guns, as well as maintaining good insulation between the electrodes.

For example, according to a manufacturing method of a cold cathode element disclosed in the Japanese Unexamined Patent Application Publication No. 6-223706, a part that has a sandwich structure is formed in which an emitter electrode and a gate electrode sandwich an insulating layer.

Subsequently, another part is formed in which metal is deposited by evaporation on a predetermined surface of another insulating material, and then the insulating part of this second part will be joined onto the gate electrode of the first sandwich structure part.

On the contrary, in the first embodiment of the present invention, as shown in FIG. 3, the gate electrode 100*c* provided on the main surface of the insulating layer 100*b*, which is included in a sandwich structure part like above, covers only the central area of the main surface. In the ring-shaped area of the main surface surrounding the central area, the gate electrode 100*c* is not provided, and the insulating layer 100*b* is exposed.

In the first embodiment, since the peripheral focusing electrode 101 is joined onto this ring-shaped area, it is not necessary to provide an insulating material for insulating the peripheral focusing electrode 101 from the gate electrode 100*c*.

Consequently, evaporation deposit process to make a peripheral focusing electrode (G1 electrode) by depositing metal on an insulating material is not necessary, unlike the manufacturing method of a cold cathode element disclosed in the publication of the prior art. Thus, it is possible to reduce manufacturing costs by omitting labor required for manufacturing electron guns.

In addition, as shown in FIG. 2 of the publication of the prior art, when a peripheral focusing electrode is provided at a position closer to the field emitter array, insulation cannot be maintained between the peripheral focusing electrode and the gate electrode, and conventionally there is possibility that a short circuit occurs between the electrodes, and the electron gun does not function.

In order to solve this problem, in the present embodiment, a ring-shaped groove surrounding the field emitter array 100*d* is provided on the main surface, at a position between (i) the area in which the gate electrode 100*c* is provided, and (ii) the area in which the gate electrode 100*c* is not provided. By providing such a ring-shaped groove, it is possible to maintain good insulation between the peripheral focusing electrode 101 and the gate electrode 100*c*.

2. Second Embodiment

The following explains the CRT device of the second embodiment of the present invention with reference to the drawings. The CRT device of the second embodiment has the substantially same structure as the CRT device of the first embodiment, but differs in the shape of the peripheral focusing electrode.

Figure 9:
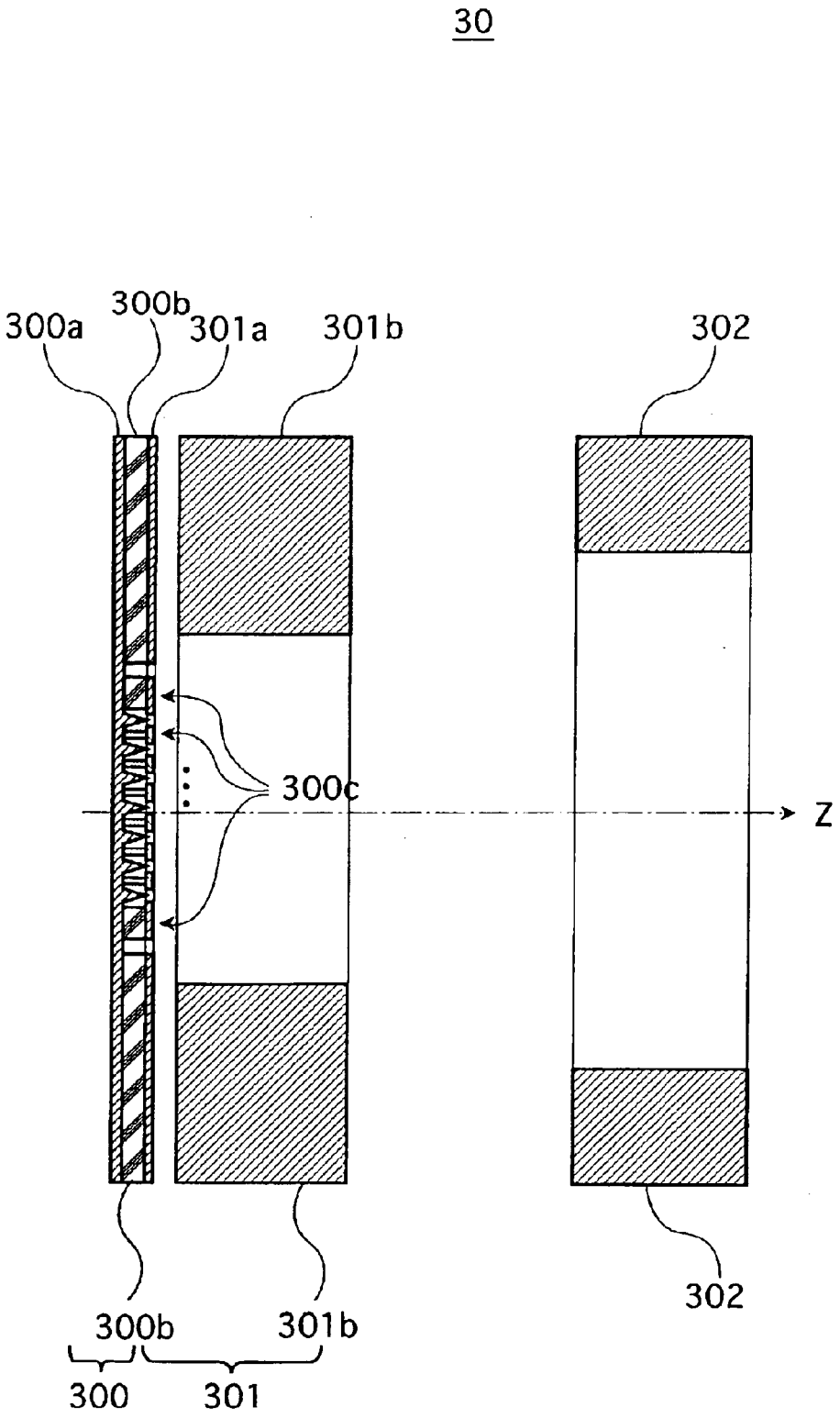
FIG. 9 is a longitudinal sectional view including the tube axis Z of the electron gun comprised in the CRT device of the second embodiment, particularly showing the structure around the vicinity of the peripheral focusing electrode.

FIG. 9 is a longitudinal sectional view including the tube axis Z of the electron gun comprised in the CRT device of the second embodiment, particularly showing the structure around the vicinity of the peripheral focusing electrode.

As shown in FIG. 9, the electron gun 30 has the substantially same structure as the electron gun 10, and comprises a cathode 300 in which an emitter electrode 300*a* and a gate electrode 300*c* are joined together with an insulating layer 300*b* interposed therebetween, as well as a peripheral focusing electrode 301 and an accelerating electrode 302.

The electron gun 30 differs from the electron gun 10 in that the peripheral focusing electrode 301 is divided into a planar peripheral focusing electrode 301*a* and a three dimensional peripheral focusing electrode 301*b*, and also the planar peripheral focusing electrode 301*a* and the three dimensional peripheral focusing electrode 301*b* are apart from each other.

In addition, in the same manner as the modification example (1) of the first embodiment, the planar peripheral focusing electrode 301*a* is on the same plane as the gate electrode 300*c*.

Further, the three dimensional peripheral focusing electrode 301*b* is supported by a supporting member which is not shown in the drawing, and fixed at a position shown in FIG. 9.

Additionally, in order to give a strong focusing action to the electron beam in the vicinity of the cathode, immediately after the exit, the electric potential of the planar peripheral focusing electrode 301*a* is arranged to be lower than the electric potential of the three dimensional peripheral focusing electrode 301*b*.

With these arrangements, since the planar peripheral focusing electrode 301*a* and the three dimensional peripheral focusing electrode 301*b* are apart from each other, it is possible to prevent the planar peripheral focusing electrode 301*a* from being detached when the planar peripheral focusing electrode 301*a* and the three dimensional peripheral focusing electrode 301*b* are brought into contact in the manufacturing process, unlike in the modification example (1) of the first embodiment.

Accordingly, it is possible to prevent inconvenience such as an emission fault due to, for example, a short circuit between the emitter 300*a* and the gate electrode 300*c* which could be caused by an exfoliation detached from the planar peripheral focusing electrode 301*a* being attached to the emitter electrode 300*a*.

In the present embodiment, it is also acceptable to have an arrangement in which the electric potentials of the planar peripheral focusing electrode 301*a* and the three dimensional peripheral focusing electrode 301*b* are the same. It is possible to achieve the same effects as above in this case as well.

2-1. Modification Example of the Second Embodiment

Figure 10:
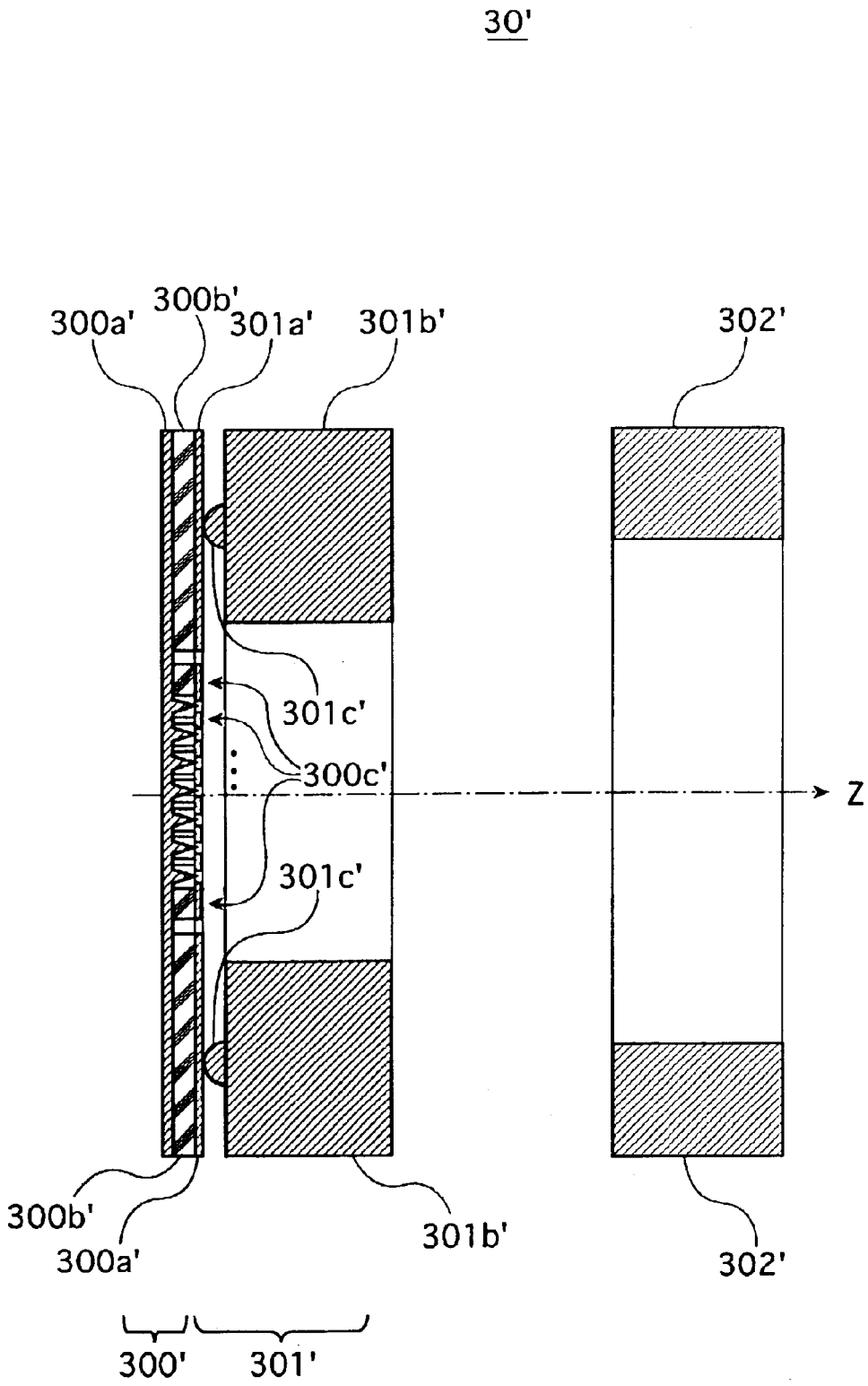
FIG. 10 is a longitudinal sectional view including the tube axis Z of the electron gun comprised in the CRT device of a modification example of the second embodiment, particularly showing the structure around the vicinity of the peripheral focusing electrode.

In the second embodiment above, the planar peripheral focusing electrode 301*a* and the three dimensional peripheral focusing electrode 301*b* are apart from each other; however, it is also acceptable to arrange them as the following:

FIG. 10 is a longitudinal sectional view including the tube axis Z of the electron gun comprised in the CRT device of this modification example, particularly showing the structure around the vicinity of the peripheral focusing electrode.

As show in FIG. 10, the electron gun 30' has the substantially same structure as the electron gun 10 of the first embodiment, and comprises the cathode 300', the peripheral focusing electrode 301' and so on.

The electron gun 30' differs from the electron gun 30 in that the three dimensional peripheral focusing electrode 301*b'* has protrusions 301*c'* that are conductive, and the three dimensional peripheral focusing electrode 301*b'* is in contact with the planar peripheral focusing electrode 301*a'* at the protrusions 301*c'*.

In other words, the planar peripheral focusing electrode 301*a'* and the three dimensional peripheral focusing electrode 301*b'* are electrically connected via the protrusions 301*c'*.

With this arrangement, when the electric potentials of the planar peripheral focusing electrode 301*a'* and the three dimensional peripheral focusing electrode 301*b'* are the same, it is not necessary to individually provide a terminal for applying a voltage, and thus it is more advantageous for manufacturing the electron guns.

Additionally, as for the positioning of the protrusions, it is acceptable, for example, that the protrusions are disposed at each of the vertexes of a triangle that surrounds the central axis of the ring-shaped three dimensional peripheral focusing electrode 301*b'*.

In such a case, it would be more preferable if the protrusions are disposed so that the triangle with vertexes of three protrusions is an equilateral triangle.

3. Third Embodiment

The following explains the CRT device of the third embodiment of the present invention. The CRT device of the present embodiment has the substantially same structure as the CRT device of the first embodiment, but differs from it in the shape of the peripheral focusing electrode.

Figure 11:
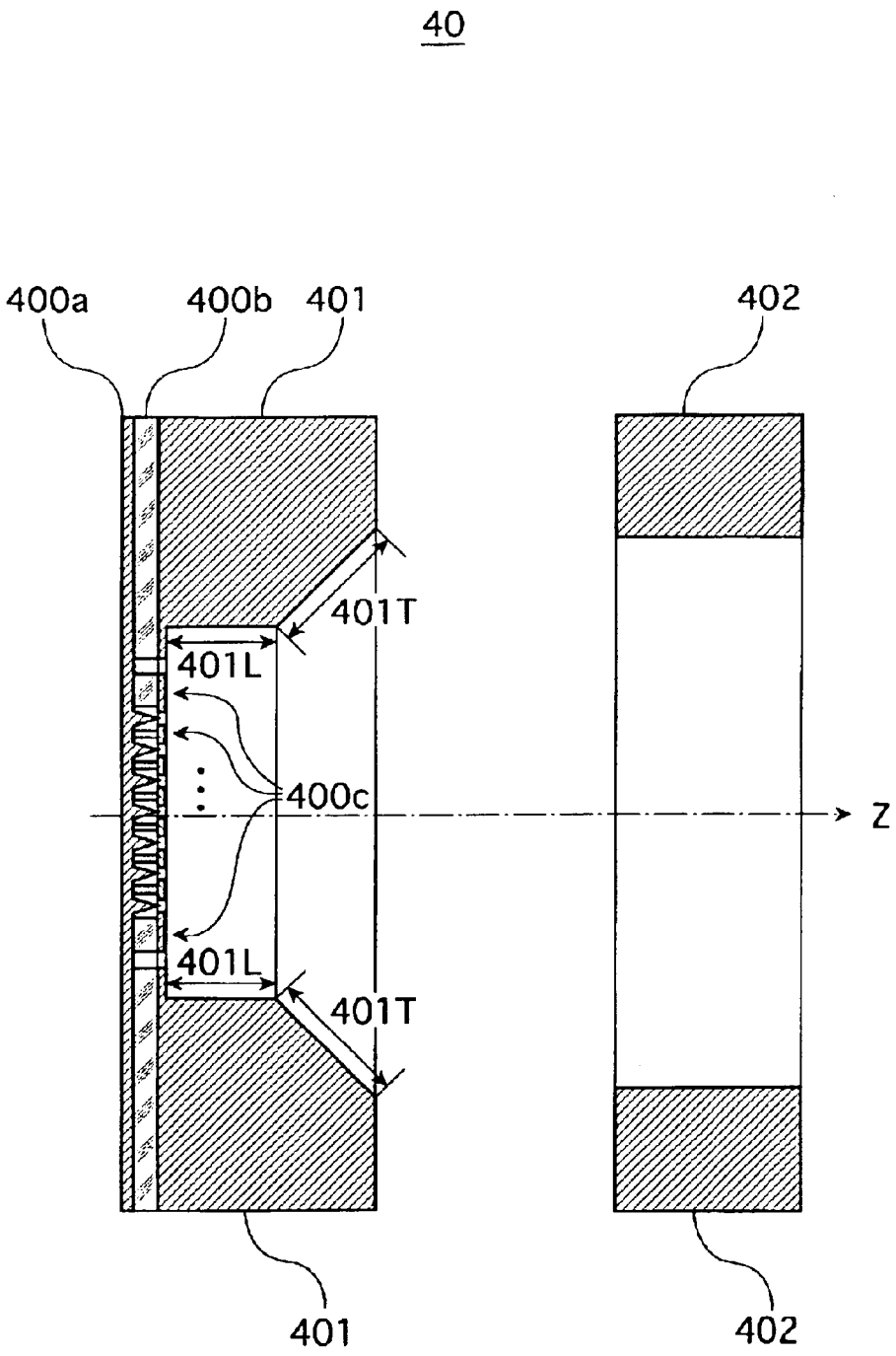
FIG. 11 is a longitudinal sectional view including the tube axis Z of the electron gun comprised in the CRT device of the third embodiment, particularly showing the structure around the vicinity of the peripheral focusing electrode.

FIG. 11 is a longitudinal sectional view including the tube axis Z of the electron gun comprised in the CRT device of the third embodiment, particularly showing the structure around the vicinity of the peripheral focusing electrode.

As shown in FIG. 11, the electron gun 40 has the substantially same structure as the electron gun 10 of the first embodiment, and comprises the cathode 400, the peripheral focusing electrode 401, and so on.

The electron gun 40 differs from the electron gun 10 in that the inner wall of the peripheral focusing electrode 401 (i.e. the wall that faces the central axis of the ring-shaped peripheral focusing electrode 401) has (i) a perpendicular wall 401L which is perpendicular to the main surface of the cathode 400 and (ii) a slanted wall 401T which is slanted at a fixed angle with respect to the perpendicular wall 401L.

With this arrangement, while the perpendicular wall 401L helps maintaining the strength of the cathode lens, the slanted wall 401T prevents electrons emitted from the cathode 400 from colliding with the peripheral focusing electrode 401 or from being made to change their orbits toward an unexpected direction due to the electric field in the vicinity of the peripheral focusing electrode 401.

Consequently, it is possible to further enhance the strength of the electric field lens with a small curvature that is formed in the vicinity of the cathode 400. In addition, it is possible to further reduce the diameter of the electron beam at the crossover because it is possible to enlarge the influence of the electric field formed by the accelerating electrode 402 on the electron beam.

It should be noted that, in FIG. 11, the angle of the slanted wall 401T is fixed; however, the angle does not necessarily have to be fixed, and it is also acceptable to have an arrangement, for example, in which the farther the inside diameter of the peripheral focusing electrode is from the cathode 400, the faster the inside diameter gets larger, like a morning glory.

No matter what shape the slanted wall has, it is desirable to arrange it so that the electrons' orbits are not obstructed, because it is then possible to prevent the electron beam from colliding with the peripheral focusing electrode 401.

Further, it is also acceptable to combine the third embodiment with the second embodiment. In other words, it is acceptable to have an arrangement so that the peripheral focusing electrode is made up of a planar peripheral focusing electrode and a three dimensional peripheral focusing electrode, and also the inner wall of the three dimensional peripheral focusing electrode comprises a perpendicular wall and a slanted wall as mentioned above. This way, it is possible to have the advantageous effects of both of the embodiments.

4. Fourth Embodiment

The following explains the CRT device of the fourth embodiment of the present invention. The CRT device of the present embodiment has the substantially same structure as the CRT device of the first embodiment, but differs from it in the shape of the cathode.

Figure 12:
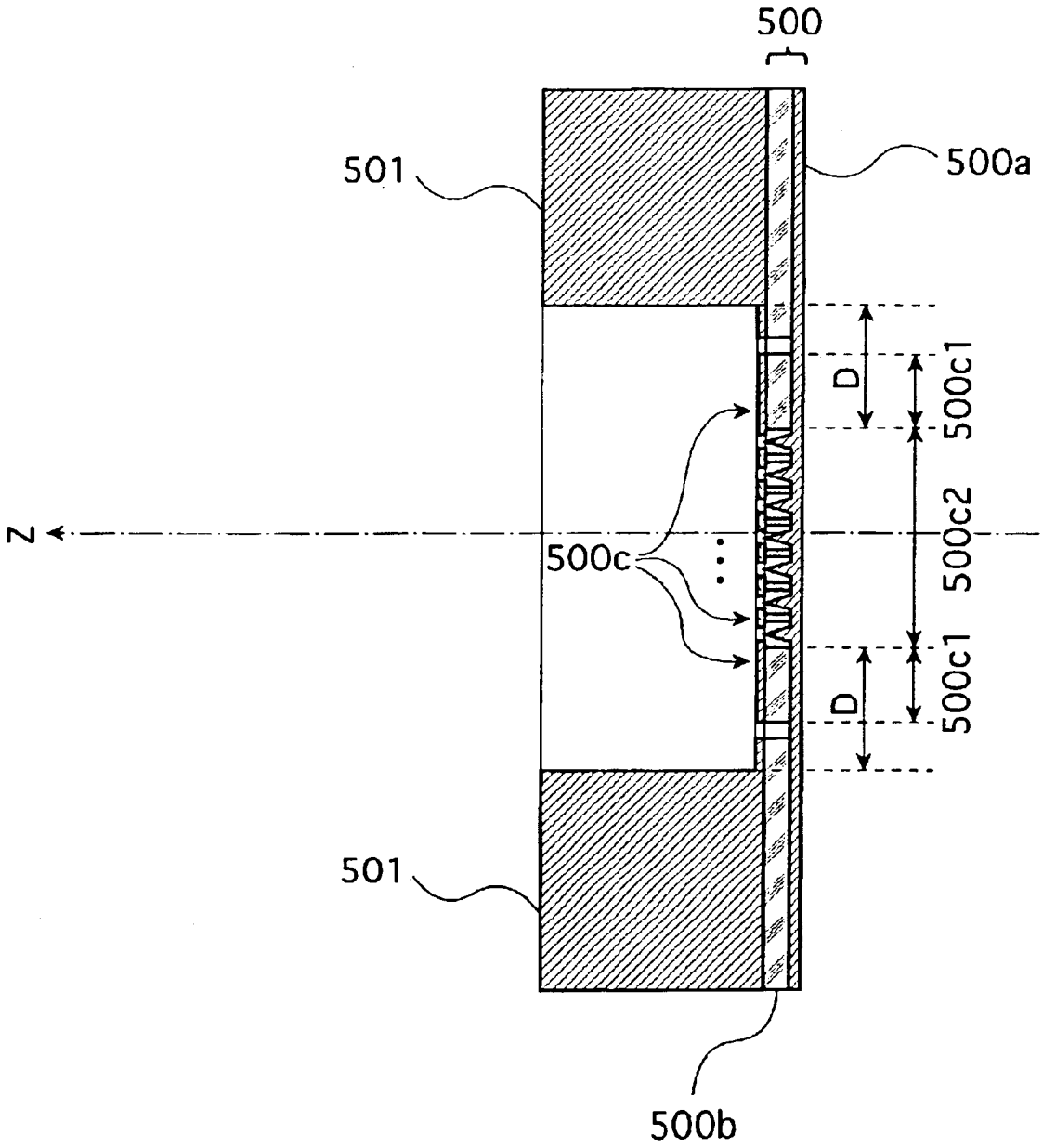
FIG. 12 is a longitudinal sectional view including the tube axis Z of the electron gun comprised in the CRT device of the fourth embodiment, particularly showing the structure around the vicinity of the peripheral focusing electrode.

FIG. 12 is a longitudinal sectional view including the tube axis Z of the electron gun comprised in the CRT device of the fourth embodiment, particularly showing the structure around the vicinity of the peripheral focusing electrode.

As shown in FIG. 12, the electron gun 50, like the electron gun 10, comprises a cathode 500, in which an emitter electrode 500*a* and a gate electrode 500*c* are joined together with an insulating layer 500*b* interposed therebetween, as well as a peripheral focusing electrode 501.

In the present embodiment, the gate electrode 500*c* is divided into a circumferential area 500*c*1 and a central area 500*c*2 depending on if the distance from the peripheral focusing electrode 501 exceeds a predetermined value D. The protrusions of the emitter electrode 500*a* are all in the central area 500*c*2. In other words, the distance from the peripheral focusing electrode 501 to each of the protrusions is no shorter than D.

Generally speaking, because the strength of the focusing action generated between the gate electrode 500*c* and the peripheral focusing electrode 501 varies depending on the distance from the peripheral focusing electrode 501, a high-order aberration tends to be caused.

Consequently, the electrons emitted from each protrusion of the emitter electrode which is positioned in the vicinity of the peripheral focusing electrode 501 collide with the peripheral focusing electrode 501, or are made to change their orbits toward an unexpected direction. As a result, there will be a disadvantageous effect that it is impossible to reduce the crossover diameter.

It is however possible to inhibit a high-order aberration and reduce the crossover diameter by arranging the distance between the protrusions of the emitter electrode and the peripheral focusing electrode long enough, as mentioned above, because there would be no difference between the electrons emitted from each emitter electrode protrusion with respect to the strength of influence that they receive from the electric field.

Additionally, it is acceptable to combine the present embodiment with the second embodiment, or with the third embodiment.

5. Fifth Embodiment

The following explains the CRT device of the fifth embodiment of the present invention. The CRT device of the present embodiment has the substantially same structure as the CRT device of the first embodiment, but differs from it in the shape of the accelerating electrode.

Figure 13:
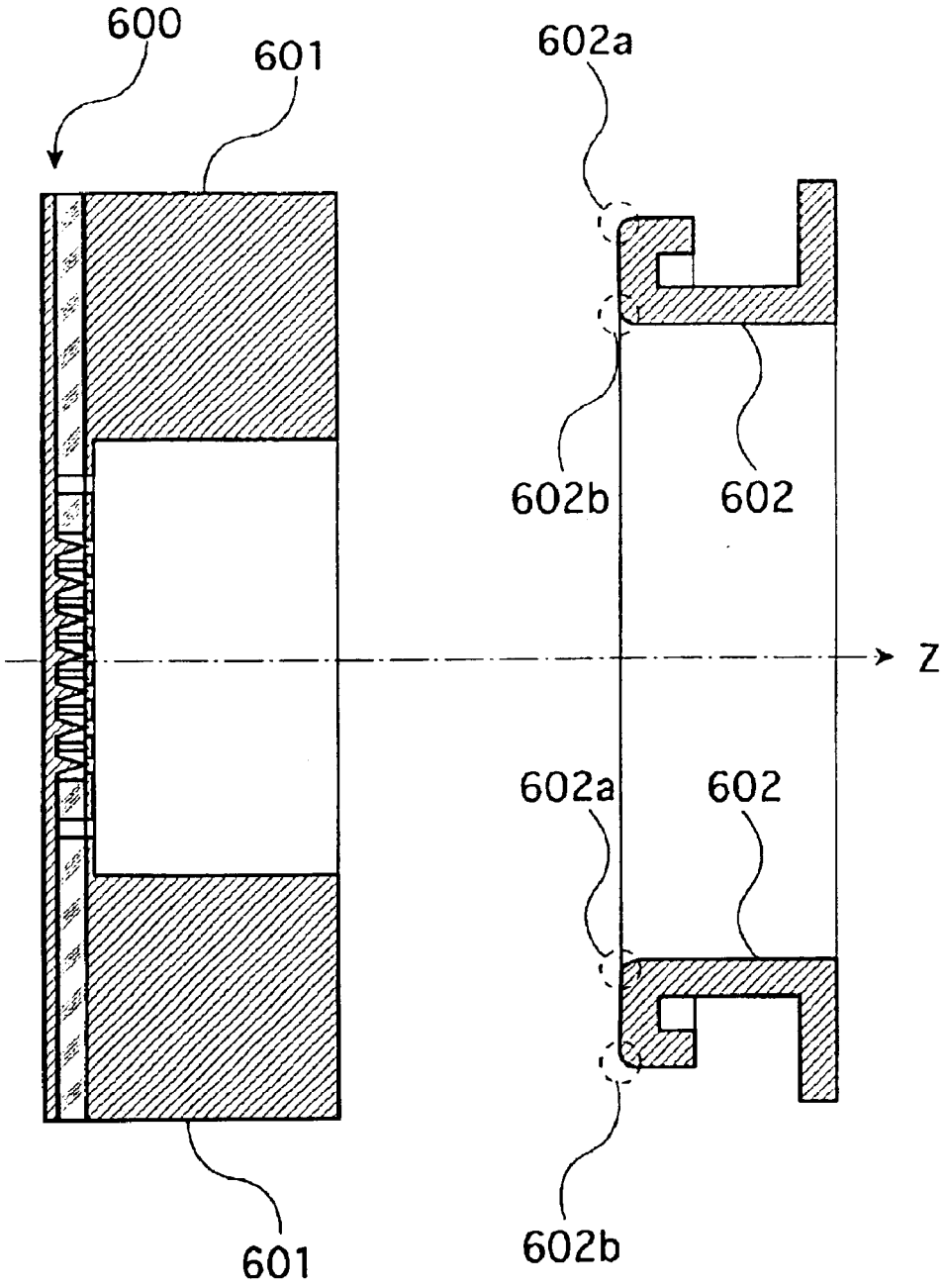
FIG. 13 is a longitudinal sectional view including the tube axis Z of the electron gun comprised in the CRT device of the fifth embodiment.

FIG. 13 is a longitudinal sectional view including the tube axis Z of the electron gun comprised in the CRT device of the fifth embodiment.

As shown in FIG. 13, the electron gun 60, like the electron gun 10, comprises a cathode 600, a peripheral focusing electrode 601, and an accelerating electrode 602. Such a part of the accelerating electrode 602 that opposes the peripheral focusing electrode 601 has radiused flange 602*a* to 602*b* that is formed by burr formation.

By radiusing the periphery of the flange of the accelerating electrode 602 positioned opposite to the peripheral focusing electrode 601, it is possible to prevent electric discharges that may be generated between the accelerating electrode 602 and the peripheral focusing electrode 601 when the electric potential difference between these electrodes is enlarged.

Consequently, as mentioned in the first embodiment, it is possible to enlarge the electric potential difference between the peripheral focusing electrode 601 and the accelerating electrode 602, enhance the electric field strength in the tube axis direction, and inhibit divergence of the electron beams; it is therefore possible to reduce the crossover diameter.

In addition, in a case where the radius of the radiused periphery of the flange disposed at a position where the peripheral focusing electrode 601 and the accelerating electrode 602 are opposing each other, the aforementioned electric discharge is more likely to be generated because the electric field gets concentrated in the vicinity of the periphery. It is therefore possible to have the advantageous effect of the present embodiment by enlarging the radius at the periphery of the flange of the peripheral focusing electrode 601 and/or the accelerating electrode 602, as well as using the technique of burr formation.

5-1. Modification Example of the Fifth Embodiment

The following modification example is also possible as to the CRT of the fifth embodiment.

In the fifth embodiment, the accelerating electrode 602 is arranged so as to include the flange 602*a* to 602*b*; however it is also possible to have an arrangement as the following:

It is acceptable to arrange the accelerating electrode 602 so as to have a ring shape like the accelerating electrode 102 in the first embodiment, and radius or chamfer the periphery of the accelerating electrode 602 so that it is rounded on the side opposing the peripheral focusing electrode.

Additionally, it is also acceptable to radius or chamfer the periphery of the peripheral focusing electrode so that it is rounded on the side opposing to the accelerating electrode. It is also acceptable to provide a flange, like the one in the embodiment above, on a side of the peripheral focusing electrode that opposes the accelerating electrode, and radius or chamfer the periphery of the flange.

With these arrangements, it is possible to have the advantageous effect of the present embodiment, which is to prevent an electric discharge that may be generated between the peripheral focusing electrode and the accelerating electrode.

6. Sixth Embodiment

Figure 14:
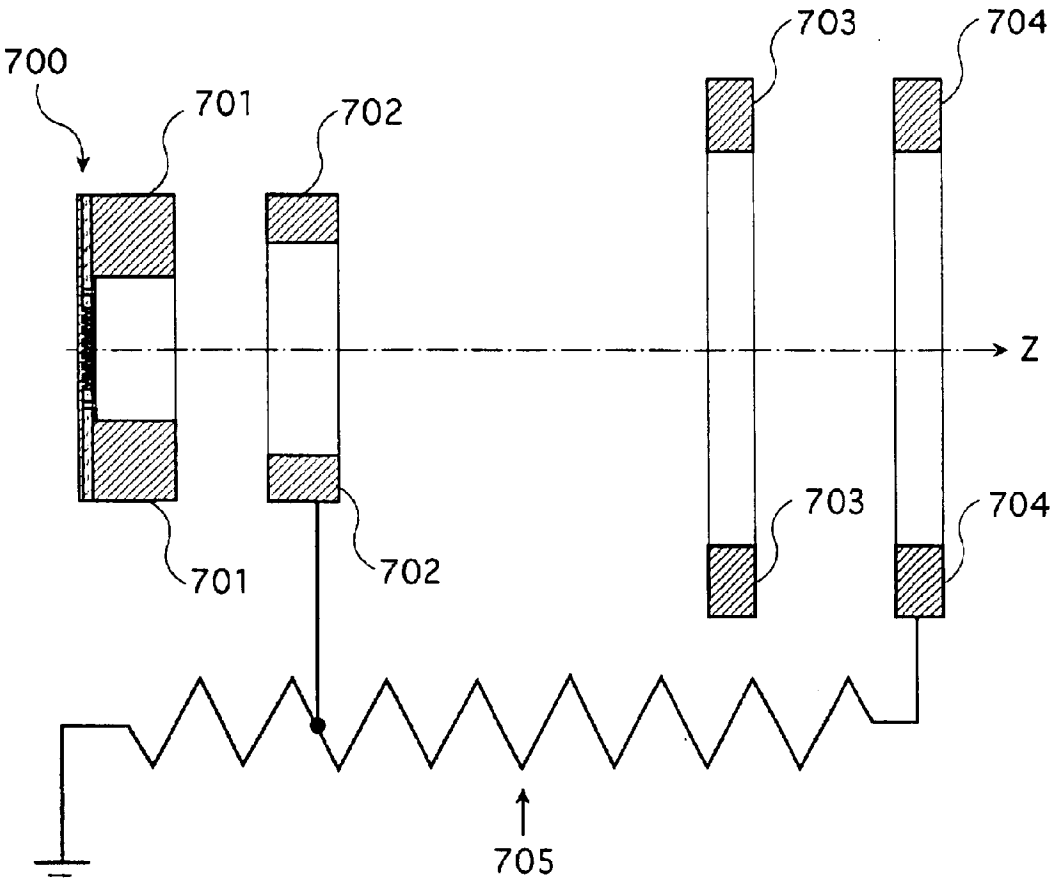
FIG. 14 is a longitudinal sectional view including the tube axis Z of the electron gun comprised in the CRT device of the sixth embodiment.

The following explains the CRT device of the sixth embodiment of the present invention. The CRT device of the present embodiment has the substantially same structure as the CRT device of the first embodiment, but has characteristics with regard to the way a voltage is applied to the accelerating electrode. FIG. 14 is a longitudinal sectional view including the tube axis Z of the electron gun comprised in the CRT device of the present embodiment.

As shown in FIG. 14, the electron gun 70 comprises a cathode 700, a peripheral focusing electrode 701, an accelerating electrode 702, a focusing electrode 703, and a final accelerating electrode 704. The focusing electrode 703, together with the final accelerating electrode 704, forms a main lens.

A voltage supplied via the anode button is applied to the final accelerating electrode 704. The voltage applied to the final accelerating electrode 704 is divided with a resistor 705 before being applied to the accelerating electrode 702.

Conventionally, the voltage applied to the accelerating electrode is supplied via the stem of the electron gun; however, when a high voltage is applied to the accelerating electrode, as in this invention, there is a possibility that a short circuit may occur because the withstand voltage between a circuit for supplying voltages to other electrodes cannot be kept high enough.

It is possible to solve this problem and apply a high voltage to the accelerating electrode 702 by dividing, with a resistor, the voltage applied to the final accelerating electrode 704 before applying it to the accelerating electrode 702, without changing the design of the stem of the electron gun that has conventionally been used.

Thus, according to the electron gun of the present embodiment, it is possible to inhibit divergence of the electron beam and reduce the crossover diameter, because it is possible to enhance the strength of the electric field in the direction of the tube axis Z by applying a high voltage to the high voltage applied to the accelerating electrode.

At the same time, since the existing structure of electron guns can be continuously used, and is good for common use, it is possible to reduce the costs of designing and manufacturing.

7. Seventh Embodiment

The following explains the CRT device of the seventh embodiment of the present invention. The CRT device of the present embodiment has the substantially same structure as the CRT device of the first embodiment, but has characteristics with regard to the way a voltage is applied to the accelerating electrode.

Figure 15:
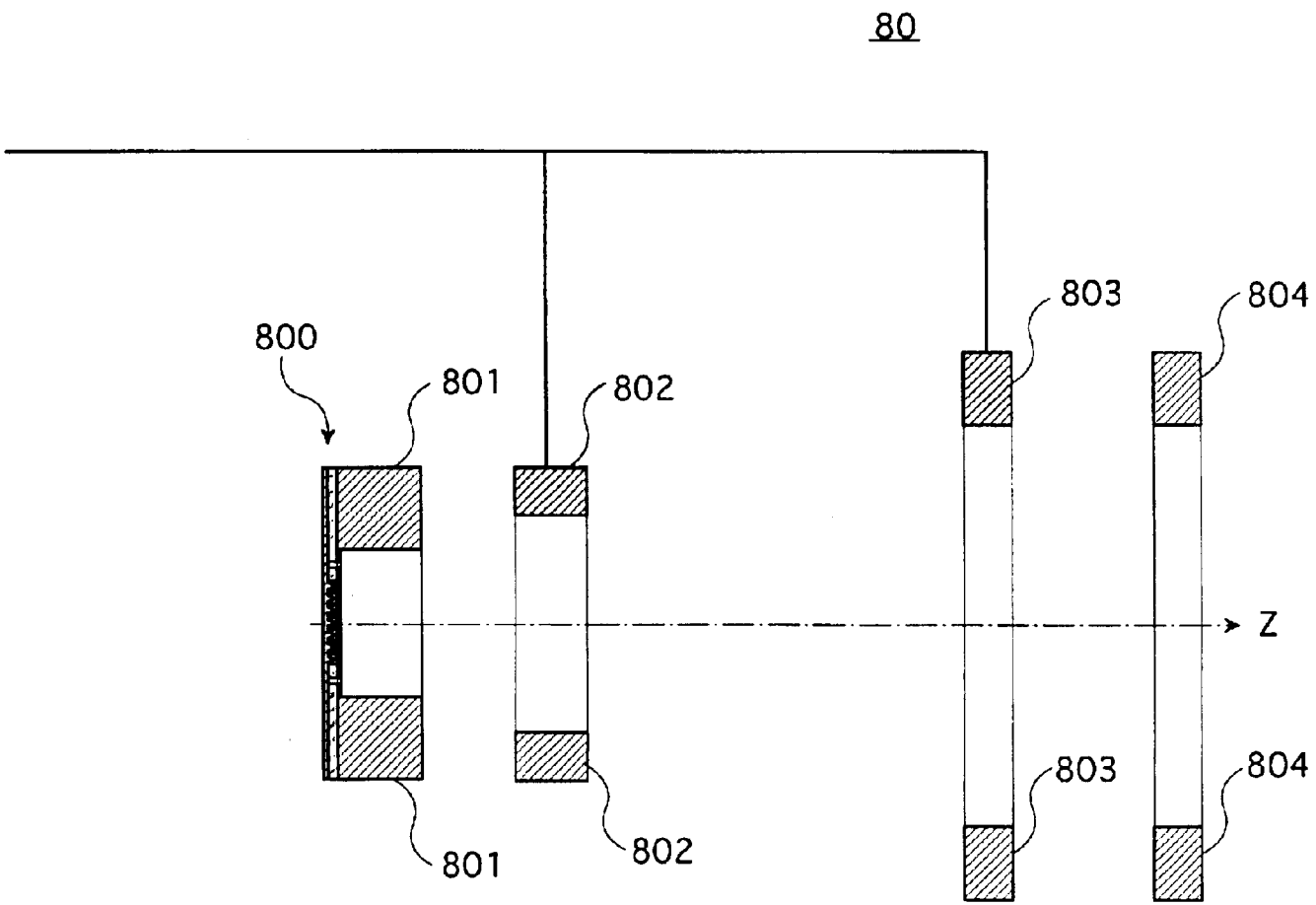
FIG. 15 is a longitudinal sectional view including the tube axis Z of the electron gun comprised in the CRT device of the seventh embodiment.

FIG. 15 is a longitudinal sectional view including the tube axis Z of the electron gun comprised in the CRT device of the seventh embodiment.

As shown in FIG. 15, the electron gun 80 comprises a cathode 800, a peripheral focusing electrode 801, an accelerating electrode 802, a focusing electrode 803, and a final accelerating electrode 804. A voltage is applied to the focusing electrode 803 via the stem of the electron gun.

In the present embodiment, the same voltage as applied to the focusing electrode 803 is also applied to the accelerating electrode 802; therefore, the focusing electrode 803 and the accelerating electrode 802 have the same electric potential.

With this arrangement, it is not possible to freely choose the value of the voltage to be applied to the accelerating electrode 802 as in the sixth embodiment, but the resistor for dividing a voltage applied to the accelerating electrode 802 is not necessary; it is therefore possible to manufacture electron guns at a lower cost.

In addition, in such a case, it is not necessary to change the design of the stem of the electron gun; it is therefore possible to reduce the costs of designing and manufacturing in that sense.

Needless to say, the voltage applied to the focusing electrode 803 is high enough to be applied to the accelerating electrode 802; therefore, according to the present embodiment, it is possible to have the advantageous effect of the present invention, which is to enhance the strength of electric field in the direction of the tube axis Z and reduce the crossover diameter.

8. Eighth Embodiment

The following explains the CRT device of the eighth embodiment of the present invention. The CRT device of the present embodiment has the substantially same structure as the CRT device of the first embodiment, and has characteristics with regard to the shapes of the peripheral focusing electrode and the accelerating electrode.

Figure 16:
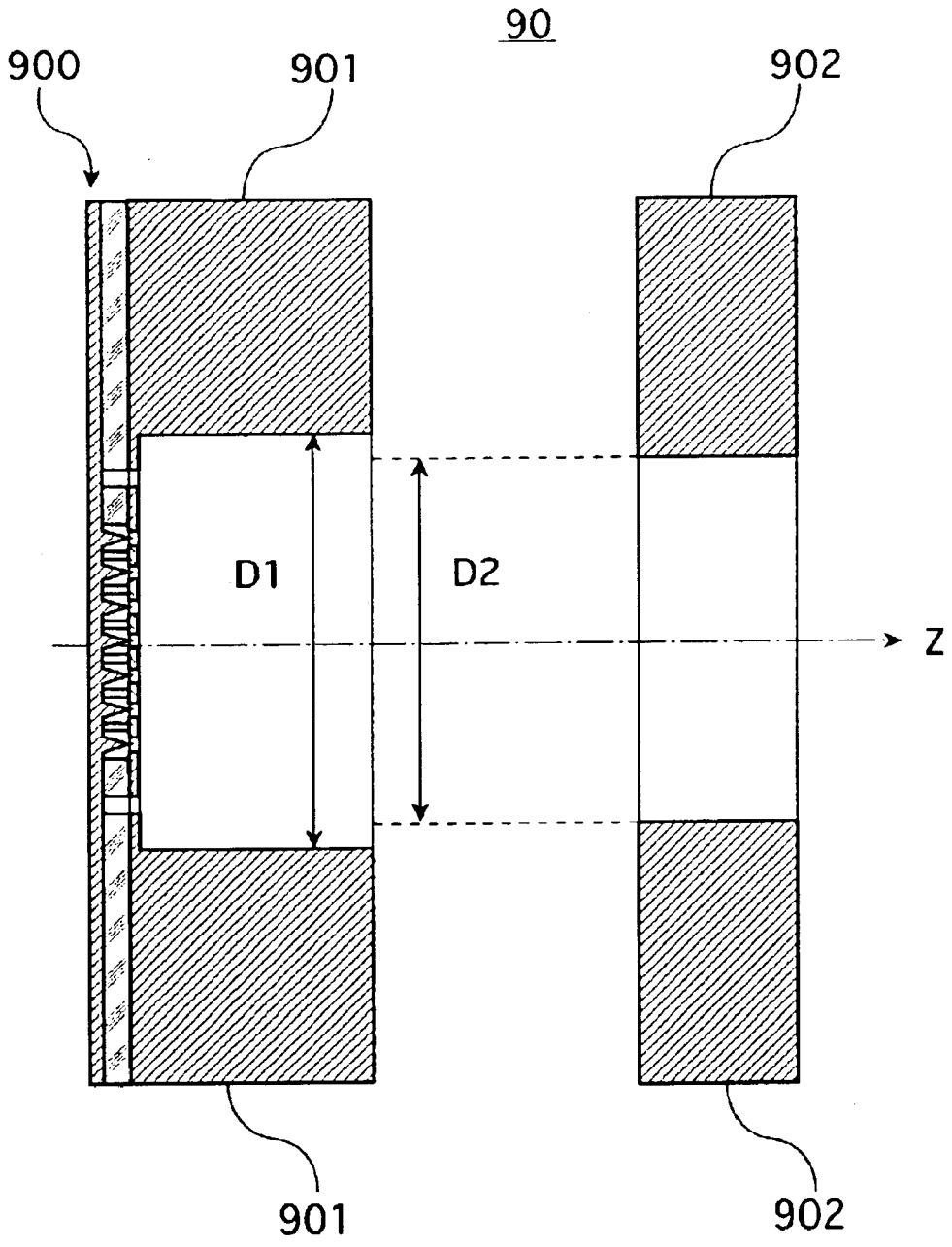
FIG. 16 is a longitudinal sectional view including the tube axis Z of the electron gun comprised in the CRT device of the eighth embodiment.

FIG. 16 is a longitudinal sectional view including the tube axis Z of the electron gun comprised in the CRT device of the eighth embodiment.

As shown in FIG. 16, the electron gun 90 comprises a cathode 900, a peripheral focusing electrode 901, an accelerating electrode 902 and so on. The diameter of the opening of the peripheral focusing electrode 901 is D1, and the diameter of the opening of the accelerating electrode 902 is D2. The present embodiment has characteristics in that the diameter of the opening of the peripheral focusing electrode 901, D1, is larger than the diameter of the opening of the accelerating electrode 902, D2.

With this arrangement, it is possible to enhance the strength of the electric field in the tube axis direction and strengthen the focusing action, and thus inhibit divergence of the electron beam by making the opening diameter of the accelerating electrode 902 smaller than the opening diameter of the peripheral focusing electrode 901.

As a result, it is possible to achieve the object of the invention, which is to render high resolution, by reducing the crossover diameter.

9. Ninth Embodiment

The following explains the CRT device of the ninth embodiment of the present invention. The CRT device of the present embodiment has a structure in which an additional electrode is added to the CRT device of the first embodiment.

Figure 17:
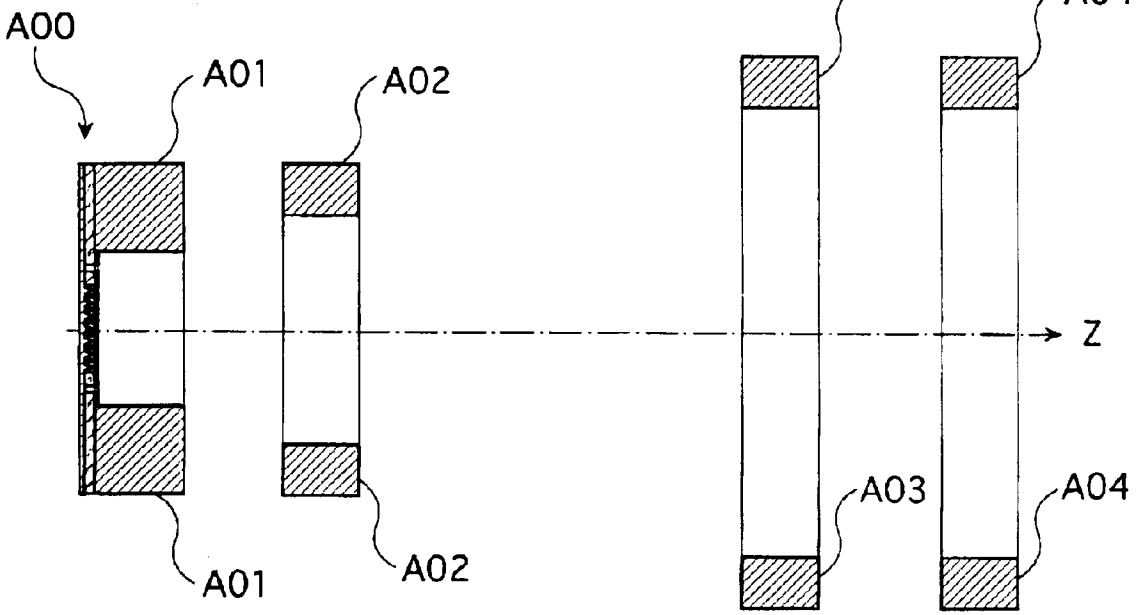
FIG. 17 is a longitudinal sectional view including the tube axis Z of the electron gun comprised in the CRT device of the ninth embodiment.

FIG. 17 is a longitudinal sectional view including the tube axis Z of the electron gun comprised in the CRT device of the ninth embodiment.

As shown in FIG. 17, the electron gun A0 comprises a cathode A00, a peripheral focusing electrode A01, an accelerating electrode A02, a focusing electrode A04, as well as an additional focusing electrode A03. The additional focusing electrode A03 is disposed between the accelerating electrode A02 and the focusing electrode A04, and has a lower electric potential than the accelerating electrode A02.

In such a structure, the accelerating electrode A02 and the additional focusing electrode A03 form an electric field lens (an additional focusing lens).

In order to have an electron beam having passed the crossover enter the main lens correctly, it is desirable to adjust the divergence angle of the electron beam with the additional focusing lens.

The divergence angle is adjusted by forming an additional focusing lens with an accelerating electrode and a focusing electrode in a thermal cathode electron gun, for instance. In the present invention, however, it is not possible to obtain an additional focusing lens having enough focusing power with such an arrangement, because a high voltage is applied to the accelerating electrode, and the moving speed of the electrons having passed the crossover is too high.

Accordingly, it is desirable to form the aforementioned additional focusing lens having high focusing power by adding the additional focusing electrode A03. With this arrangement, it is possible to adjust the divergence angle of the electron beam having passed the crossover and have the electron beam enter the main lens correctly.

9-1. Modification Examples of the Ninth Embodiment

The following modification examples are also possible as to the CRT device of the ninth embodiment:

(1) In the explanation above, the additional focusing electrode A03 is arranged to have a lower electric potential than the accelerating electrode A02; however, when such a voltage is applied to the additional focusing electrode A03, it is also possible to electrically connect the peripheral focusing electrode A01 and the additional focusing electrode A03, and make their electric potentials the same.

Since the peripheral focusing electrode has a lower electric potential than the accelerating electrode in the arrangement of the electron gun of the present invention, with this arrangement, it is possible to make the electric potential of the additional focusing electrode lower than the accelerating electrode as well.

(2) In the explanation above, only one additional focusing electrode is provided between accelerating electrode A02 and the focusing electrode A04; however, it is also possible to arrange it as the following:

It is acceptable to further provide another electrode between the additional focusing electrode A03 and the focusing electrode A04 as a second additional focusing electrode, and make the electric potential of the second additional focusing electrode higher than that of the additional focusing electrode A03.

With this arrangement, it is possible to form an additional focusing lens with even higher focusing power.

Just for information, in order to make the electric potential of the second additional focusing electrode higher than that of the additional focusing electrode A03, an arrangement can be made in which the second additional focusing electrode and the accelerating electrode A02 are electrically connected.

With this arrangement, since the accelerating electrode A02 has a higher electric potential than the additional focusing electrode A03, it is possible to make the electric potential of the second additional focusing electrode higher than that of the additional focusing electrode A03.

In addition, it is also acceptable to have an arrangement in which a voltage of an appropriate level is obtained by dividing, with a resistor, the voltage applied to the final accelerating electrode (not shown in the drawings) before applying it to the second additional focusing electrode.

10. Tenth Embodiment

The following explains the CRT device of the tenth embodiment of the present invention. The CRT device of the present invention has the substantially same structure as the CRT of the first embodiment, but differs from it in the shape of the peripheral focusing electrode.

Figure 18:
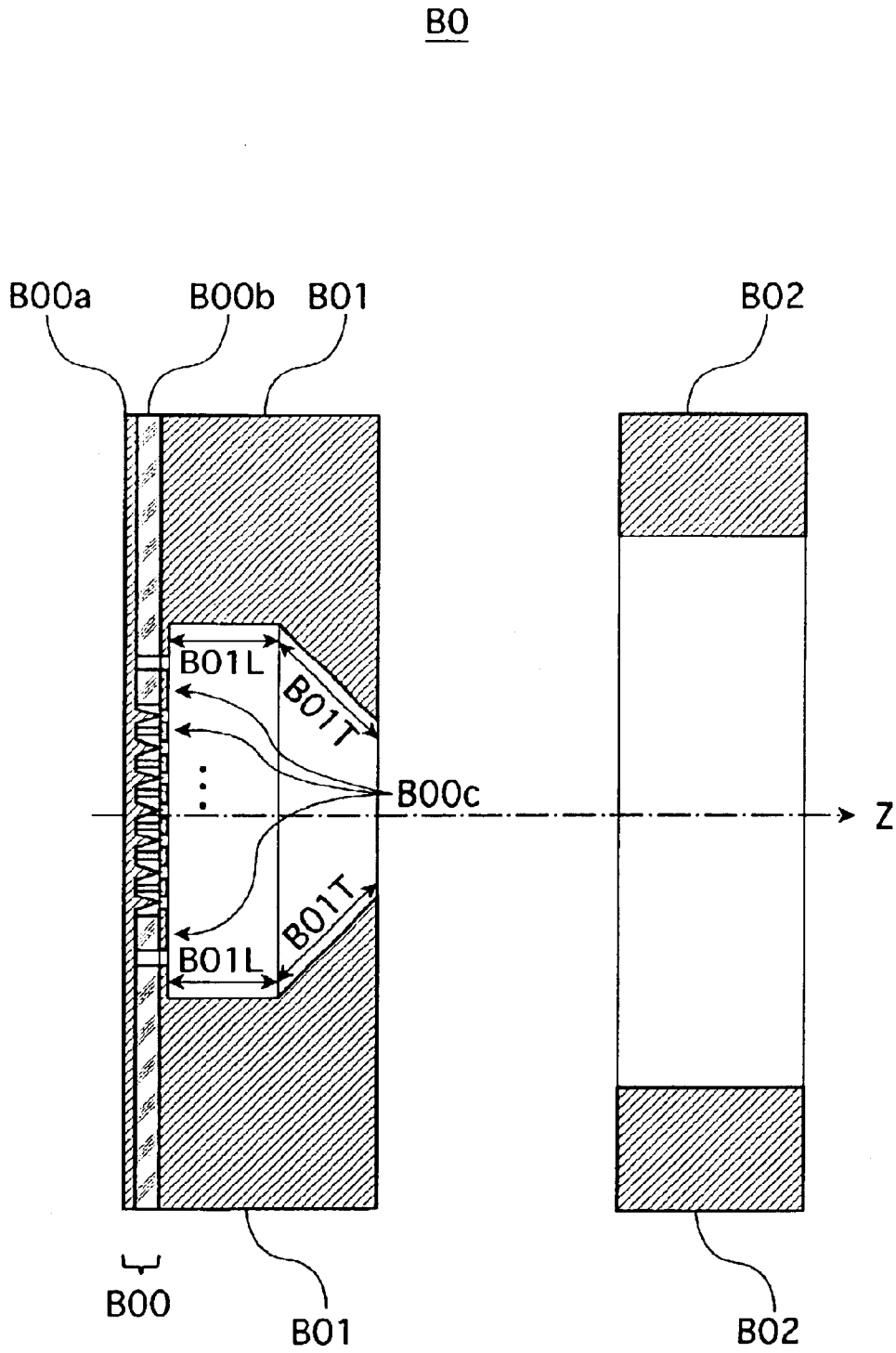
FIG. 18 is a longitudinal sectional view including the tube axis Z of the electron gun comprised in the CRT device of the tenth embodiment.

FIG. 18 is a longitudinal sectional view including the tube axis Z of the electron gun comprised in the CRT device of the tenth embodiment, particularly showing the structure around the vicinity of the peripheral focusing electrode.

As shown in FIG. 18, the electron gun B0, like the electron gun 10 of the first embodiment, comprises a cathode B00, a peripheral focusing electrode B01, and so on.

The electron gun B0 differs from the electron gun 10 in that the inner wall of the peripheral focusing electrode B01 (i.e. the wall that faces the central axis of the ring-shaped peripheral focusing electrode B01) has (i) a perpendicular wall B01L which is perpendicular to the main surface of the cathode B00 and (ii) a slanted wall B01T that is slanted at a fixed angle with respect to the perpendicular wall B01L.

With this arrangement, while preventing electrons emitted from the cathode B00 from colliding with the peripheral focusing electrode B01 by providing the perpendicular wall B01L, it is possible to enhance the strength of the electric field lens with a small curvature that is formed in the vicinity of the cathode B00, by providing the slanted wall B01T. Thus, it is possible to further reduce the diameter of the electron beam at the crossover.

It should be noted that, in FIG. 18, the angle of the slanted wall B01T is fixed; however, the angle does not necessarily have to be fixed, and it is also acceptable to have an arrangement, for example, in which the farther the inside diameter of the peripheral focusing electrode is from the cathode B00, the faster the inside diameter gets smaller.

It is also possible to have an arrangement in which only the slanted wall B01T is provided without the perpendicular inner wall B01L being provided.

In either case, it is possible to reduce the spot diameter by reducing the inside diameter of the peripheral focusing electrode and enhancing the strength of the cathode lens.

Further, it is also possible to combine the present embodiment with the second embodiment. In other words, it is acceptable to have an arrangement so that the peripheral focusing electrode is made up of a planar peripheral focusing electrode and a three dimensional peripheral focusing electrode, and also the inner wall of the three dimensional peripheral focusing electrode comprises a perpendicular wall and a slanted wall as mentioned above. This way, it is possible to have the advantageous effects of both of the embodiments.

11. Eleventh Embodiment

The following explains the CRT device of the eleventh embodiment of the present invention. The CRT device of the eleventh embodiment has the substantially same structure as the CRT device of the first embodiment, but differs in the shapes of the peripheral focusing electrode and the gate electrode.

Figure 19:
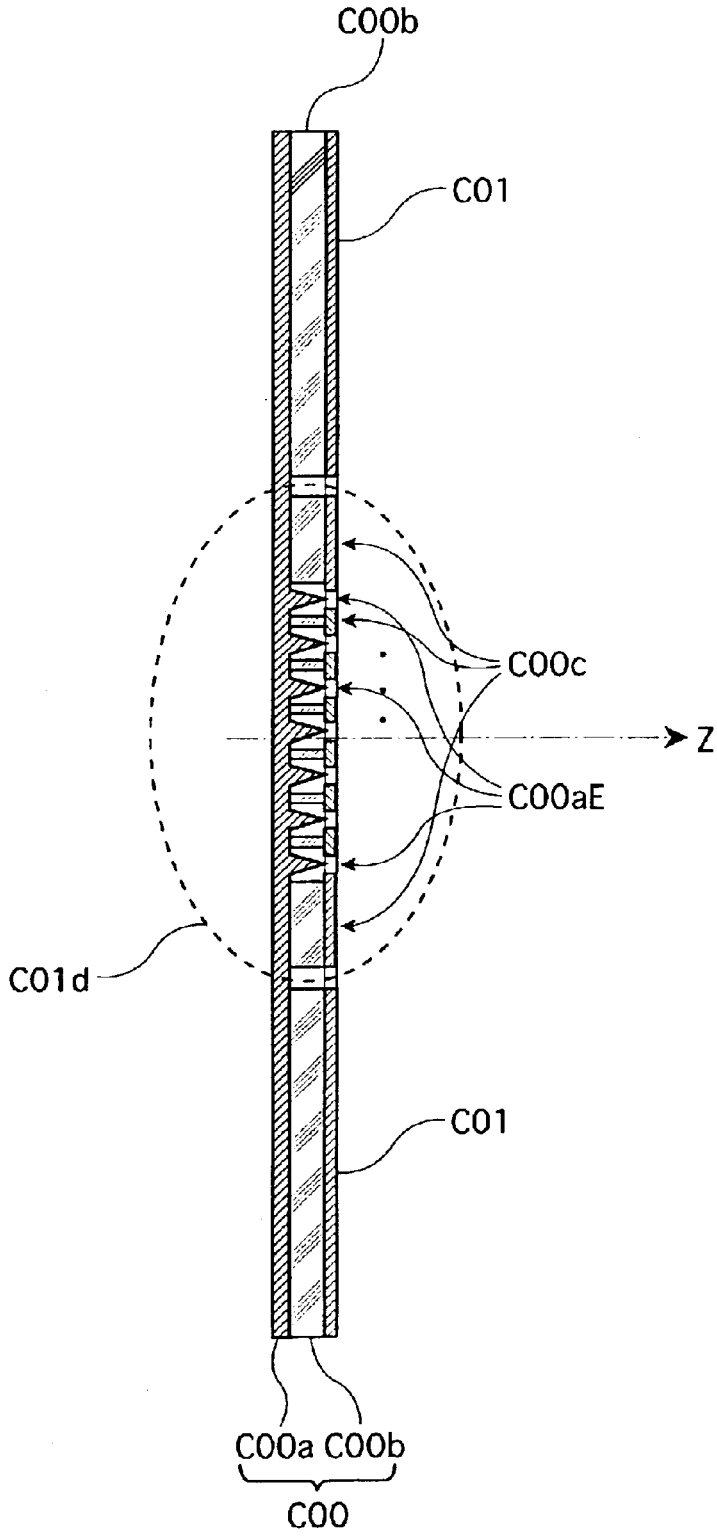
FIG. 19 is a longitudinal sectional view including the tube axis Z, showing the shapes of the cathode, the peripheral focusing electrode, and the accelerating electrode of the electron gun comprised in the CRT device of the eleventh embodiment.

FIG. 19 is a longitudinal sectional view including the tube axis Z, showing the shapes of the cathode, the peripheral focusing electrode, and the accelerating electrode of the electron gun comprised in the CRT device of the eleventh embodiment.

As shown in FIG. 19, the cathode C00 comprises an emitter electrode C00*a*, an insulating layer C00*b*, and a gate electrode C00*c*, and has a sandwich structure in which the insulating layer C00*b* is interposed between the emitter electrode C00*a* and the gate electrode C00*c*.

Of the emitter electrode C00*a*, the part that has the protrusions C00*a*E will be referred to as a field emitter array C00*d*.

A peripheral focusing electrode C01 is provided on the insulating layer C00*b* around the gate electrode C00*c*. The peripheral focusing electrode C01 is, like the gate electrode C00*c*, disposed opposing to the emitter electrode C00*a* with the insulating layer C00*b* interposed therebetween, so as to make a sandwich structure.

Figure 20:
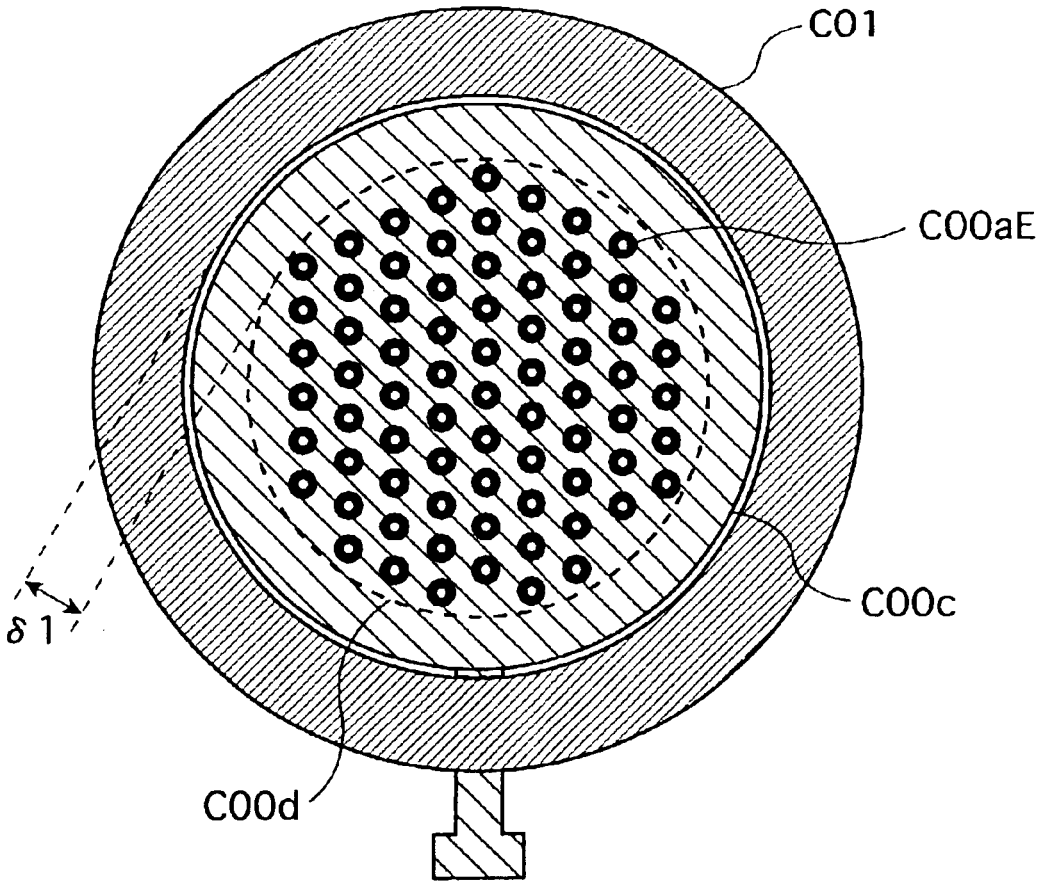
FIG. 20 shows the cathode C00 and the peripheral focusing electrode C01 of the eleventh embodiment that are viewed from the display screen side.

FIG. 20 shows the cathode C00 and the peripheral focusing electrode C01 of the eleventh embodiment that are viewed from the display screen side.

As shown in FIG. 20, the cathode C00 and the peripheral focusing electrode C01 together are in the shape of a disc as a whole.

The field emitter array C00*d* is concentrated at the central area of the main surface of the cathode. All of the protrusions C00*a*E of the emitter electrode C00*a* are positioned δ1 or more apart from the peripheral focusing electrode C01, where δ1 denotes a predetermined distance.

In the present embodiment, the predetermined distance δ1 is 0.05 mm. Since spatial potential varies largely in the vicinity of the peripheral focusing electrode C01, it is possible to diminish variation in influences of the peripheral focusing electrode C01 given on the electrons emitted from some of the protrusions C00*a*E that are positioned relatively closer to the peripheral focusing electrode C01, by disposing all the protrusions C00*a*E apart from the peripheral focusing electrode C01, as shown in FIG. 20.

Consequently, it is possible to reduce a high-order aberration of the cathode lens, and thus possible to reduce the spot diameter.

According to simulations performed by the inventor and others, it is possible to expect to have the advantageous effect of reducing the high-order aberration and reducing the spot diameter, when the distance from the peripheral focusing electrode C01 to each of the protrusions C00*a*E is at least 0.01 mm.

11-1. Modification Examples of the Eleventh Embodiment

The following modification examples are also possible as to the CRT of the eleventh embodiment.

Figure 21:
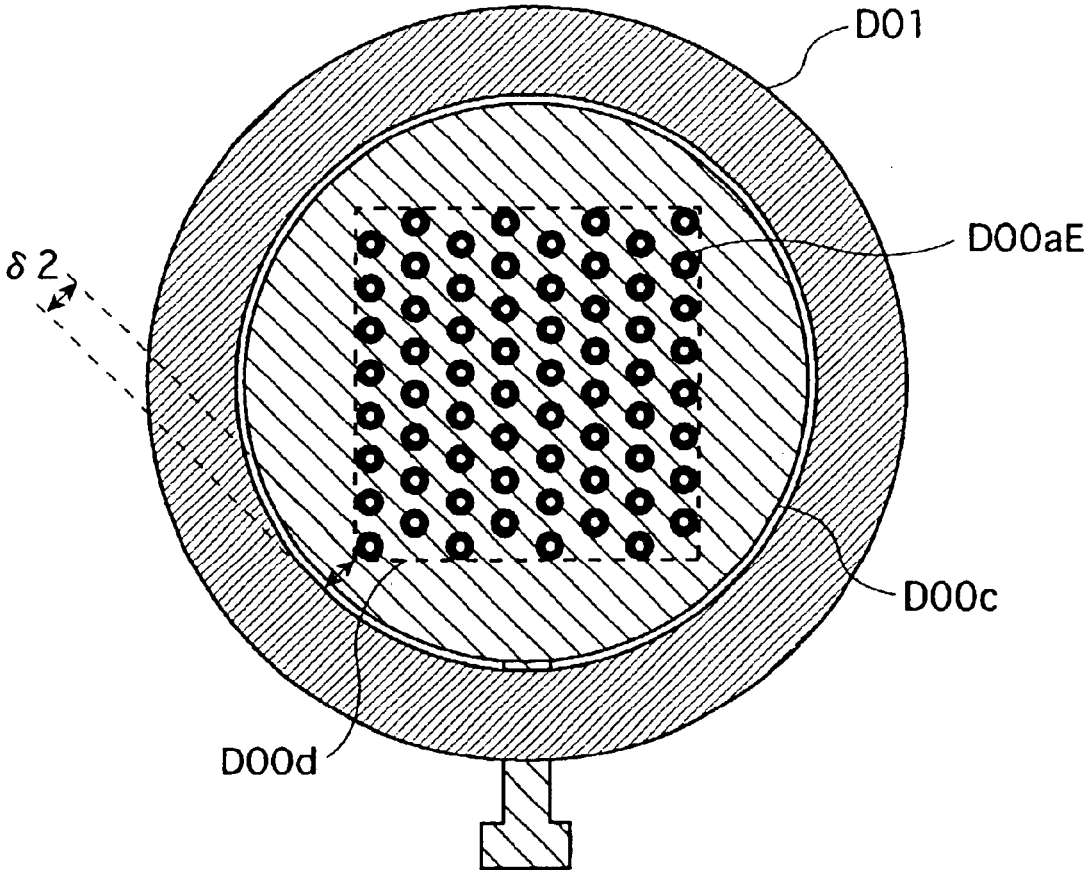
FIG. 21 shows the field emitter array etc. of the CRT device of the modification example (1) of the eleventh embodiment that are viewed from the display screen side.

(1) In the eleventh embodiment above, explanation is provided on a case where the gate electrode C00*c* has a circular shape when viewed from the display screen side; however, the present invention is not limited to this, and it is acceptable to arrange the gate electrode C00*c* as the following:

FIG. 21 shows the field emitter array etc. of the CRT device of the present modification example that are viewed from the display screen side. As shown in FIG. 21, the gate electrode D00*c* of the present modification example has a circular shape in the plan view, and is surrounded by the peripheral focusing electrode D01.

This is the same arrangement as in FIG. 20 in which the gate electrode C00*c* is surrounded by the peripheral focusing electrode C01.

At the central area of the main surface of the gate electrode D00*c*, a plurality of protrusions D00*a*E of the emitter electrode are provided so as to form a field emitter array D00*d*. The field emitter array D00*d* occupies a square area.

All of the protrusions D00*a*E are positioned δ2 or more apart from the peripheral focusing electrode D01, where δ2 denotes a predetermined distance. The predetermined distance δ2 is 0.05 mm, for example.

The area size of the square area indicated with a broken line in FIG. 21 is substantially the same as the area size of the circular area indicated with a broken line in FIG. 20. The number of the protrusions D00*a*E of the field emitter array D00*d* is substantially the same as the number of the protrusions C00*a*E of the field emitter array C00*d*.

By making such an arrangement wherein the area size of the field emitter array D00*d* is substantially the same as the field emitter array C00*d*, and also the area is square, it is possible to reduce the spot diameter in both of the horizontal direction and the vertical direction of the screen display, while maintaining the output at the substantially same level as the field emitter array C00*d*.

Additionally, when the field emitter array D00*a*E is arranged merely to be square, a high-order aberration will be large because the distance between the vicinity of the vertexes and the peripheral focusing electrode D01 is short.

On the contrary, when all of the protrusions D00*a*E are positioned δ2 (a predetermined distance) or more apart from the peripheral focusing electrode D01 as in the present embodiment, it is possible to inhibit the high-order aberration and reduce the spot diameter.

Furthermore, similar to the eleventh embodiment above, it is possible to have the expected advantageous effects when the predetermined distance δ2 is 0.01 mm or more, even if it is smaller than 0.05 mm.

Figure 22:
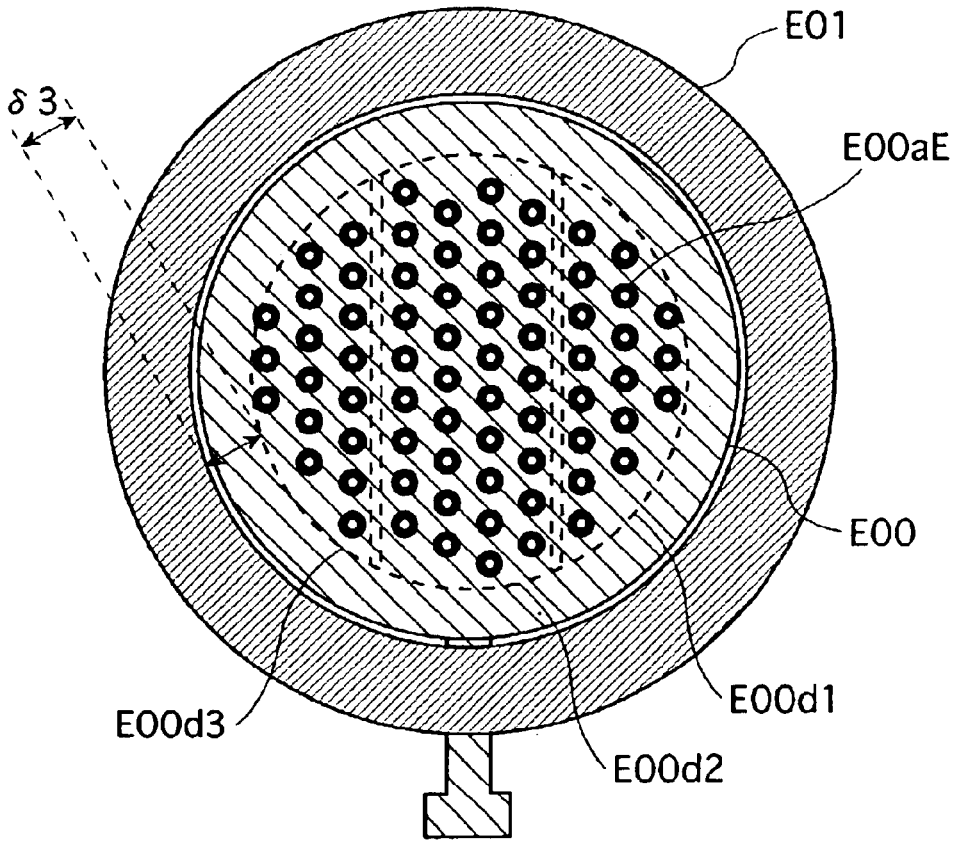
FIG. 22 shows the field emitter array etc. of the CRT device of the modification example (2) of the eleventh embodiment that are viewed from the display screen side.

(2) In the eleventh embodiment above, electrons are always emitted from all of the protrusions C00*a*E of the field emitter array C00*d*; however, the present invention is not limited to this, needless to say. It is possible to have the advantageous effects of the present invention with the following modification example:

FIG. 22 is the field emitter array etc. of the CRT device of the present modification example that are viewed from the display screen side.

As shown in FIG. 22, in the present modification example as well, the gate electrode E00*c*, which has a circular shape in the plan view, is surrounded by the peripheral focusing electrode E01. Also, a plurality of protrusions E00*a*E of the emitter electrode is provided at the central area of the main surface of the gate electrode E00*c* so as to form a field emitter array.

The characteristics of the present modification example includes the arrangement in which the field emitter array is divided into (i) a field emitter array E00*d*2 which is positioned in the central area in the horizontal direction, and (ii) field emitter arrays E00*d*1 and E00*d*3 which are positioned on both sides of the E00*d*2 in the horizontal direction.

All of the protrusions E00*a*E included in the field emitter arrays E00*d*1 to E00*d*3 are positioned δ3 or more apart from the peripheral focusing electrode E01, where δ3 denotes a predetermined distance.

These field emitter arrays E00*d*1 to E00*d*3 work as follows: When an electron beam scans the central area of the display screen, all three of the field emitter arrays E00*d*1 to E00*d*3 emit electrons.

On the other hand, when an electron beam scans the perimeter area of the display screen, only the field emitter array E00*d*2, which is positioned at the central area in the horizontal direction, emits electrons.

The larger the deflection angle of an electron beam is, the less acute the angle at which the electron beam irradiates the display screen is. Thus, the larger the deflection angle is, the larger the spot diameter will be.

In view of this situation, with the arrangement in the present modification example, it is possible to reduce the spot diameter as a result of the field emitter arrays E00*d*1 and E00*d*3 on the both sides not emitting electrons, because when the deflection angle is larger than a predetermined value, electrons are emitted only from the field emitter array E00*d*2 positioned in the central area.

In such a case, when the field emitter arrays E00*d*1 to E00*d*3 are positioned close to the peripheral focusing electrode, influence of a high-order aberration is unavoidable, and the spot diameter would be large.

In order to cope with this problem, when all of the protrusions E00*a*E of the field emitter array are positioned δ3 or more apart from the peripheral focusing electrode E01, as in the present embodiment, it is possible to avoid the influence of the high-order aberration, and to reduce the spot diameter.

This arrangement is particularly effective when the central area of the screen display is scanned, in other words, when electrons are emitted from all three of the field emitter arrays E00*d*1 to E00*d*3.

12. Advantageous Effects of the Present Invention

As so far explained, the CRT of the present invention comprises a voltage applying unit operable to apply a high voltage to the accelerating electrode, and is able to make the electric potential of the accelerating electrode higher than those of the emitter electrode and the peripheral focusing electrode.

Accordingly, it is possible to render high resolution through reduction of the divergence angle of the electron beam by strengthening the electric field formed by the accelerating electrode, and reduction of the crossover diameter to make it smaller than the electron emissions diameter.

Generally speaking, luminance of a CRT depends on the electric current density at the object point of the main lens of the electron gun. Thus, the higher the electric current density at the object point is, the higher the luminance will be.

With regard to this point, in the aforementioned prior art, since the field emitter array itself is the object point of the main lens, it is not possible to achieve high enough luminance unless the protrusions of the emitter electrode are disposed very densely.

On the other hand, in the present invention, an arrangement is made in which the crossover diameter is reduced by applying a high voltage to the accelerating electrode, and the electric density at the object point of the main lens is high, it is possible to achieve high enough luminance with an emitter electrode that has a lower density than the aforementioned prior art.

Consequently, it is possible to reduce manufacturing costs of field emitter arrays, and by extension, reduce manufacturing costs of CRT devices.

In addition, as for the Coulomb repulsion between electrons which is discussed as a problem of the aforementioned prior art, by applying a high voltage to the accelerating electrode as in the present embodiment, it is possible to enhance the electric field strength at the front side of the field emitter array. Thus, it is possible to adjust the orbit of each electron before the electrons emitted from the field emitter array reach the crossover and influence one another with Coulomb repulsion, and to reduce the crossover diameter.

Further, as mentioned above, the high-order aberration gets prominent when the focusing power of the electric field lens is enhanced by making the electric potential of the accelerating electrode higher than those of the emitter electrode and the peripheral focusing electrode so as to form a strong electric field.

With regard to this problem, according to the present invention, since the emitter electrode and the peripheral focusing electrode are more than a predetermined distance apart from each other, it is possible to make an arrangement in which the electron beam does not go through the periphery of the electric field lens, where the influence of a high-order aberration is prominently received.

Consequently, it is possible to provide a CRT device with higher resolution because it is possible to reduce the spot diameter while avoiding the influence of a high-order aberration.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A CRT device comprising:

a cold cathode electron gun that includes (a) an emitter electrode from which electrons are emitted, (b) a gate electrode that is disposed on a display screen side in a tube axis direction relative to the emitter electrode, and is operable to control the emission of the electrons from the emitter electrode, (c) a peripheral focusing electrode that is disposed on the emitter electrode with an insulating layer interposed therebetween, is disposed on the display screen side in the tube axis direction relative to the emitter electrode, is thicker than the gate electrode, and surrounds the gate electrode, and (d) an accelerating electrode that is disposed on the display screen side in the tube axis direction relative to the peripheral focusing electrode; and a voltage applying unit operable to apply a voltage to each of the accelerating electrode, the gate electrode, and the peripheral focusing electrode, so as to form a crossover by making the voltage of the accelerating electrode higher than the voltages of the gate electrode and the peripheral focusing electrode.

2. The CRT device of claim 1, wherein the cold cathode electron gun further includes:

a focusing electrode disposed on the display screen side in the tube axis direction relative to the accelerating electrode; and a final accelerating electrode disposed on the display screen side in the tube axis direction relative to the focusing electrode, and the voltage applying unit divides, with a resistor, a voltage applied to the final accelerating electrode, and applies the divided voltage to the accelerating electrode.

3. The CRT device of claim 2, further comprising an additional focusing electrode that is provided between the accelerating electrode and the focusing electrode, and has a lower voltage than the accelerating electrode.

4. The CRT device of claim 3, wherein the additional focusing electrode is electrically connected with the peripheral focusing electrode.

5. The CRT device of claim 3, wherein the cold cathode electron gun further includes a second additional focusing electrode that is provided between the additional focusing electrode and the focusing electrode, and a voltage applied to the final accelerating electrode is divided with a resistor and is applied to the second additional focusing electrode.

6. The CRT device of claim 1, wherein the cold cathode electron gun further includes:

a focusing electrode disposed on the display screen side in the tube axis direction relative to the accelerating electrode; and a final accelerating electrode disposed on the display screen side in the tube axis direction relative to the focusing electrode, and the voltage applying unit applies a voltage that is applied to the focusing electrode also to the accelerating electrode.

7. The CRT device of claim 1, wherein the peripheral focusing electrode is made up of at least (i) a first peripheral focusing electrode that has a substantially same thickness as the gate electrode, is substantially aligned with the gate electrode with respect to positions in the tube axis direction, and surrounds the gate electrode, and (ii) a second peripheral focusing electrode that is disposed on the display screen side in the tube axis direction relative to the first peripheral focusing electrode.

8. The CRT device of claim 7, wherein an inside diameter of the second peripheral focusing electrode increases towards the accelerating electrode.

9. The CRT device of claim 8, wherein an internal wall of the second peripheral focusing electrode is parallel to a central axis of the second peripheral focusing electrode in a vicinity of the gate electrode.

10. The CRT device of claim 7, wherein an inside diameter of the second peripheral focusing electrode decreases towards the accelerating electrode.

11. The CRT device of claim 7, wherein a main surface of the second peripheral focusing electrode facing the first peripheral focusing electrode has one or more electrically conductive protrusions that are in contact with the first peripheral focusing electrode.

12. The CRT device of claim 11, wherein the second peripheral focusing electrode is ring-shaped in a plan view, and the protrusions are positioned at each of vertexes of a triangle that surrounds the central axis of the second peripheral focusing electrode.

13. The CRT device of claim 12, wherein the triangle is an equilateral triangle.

14. The CRT device of claim 7, wherein an inside diameter of the first peripheral focusing electrode is smaller than an inside diameter of the second peripheral focusing electrode.

15. The CRT device of claim 7, wherein the first peripheral focusing electrode is apart from the second peripheral focusing electrode.

16. The CRT device of claim 7, wherein the first peripheral focusing electrode has a lower voltage than the second peripheral focusing electrode.

17. The CRT device of claim 1, wherein an inside diameter of the peripheral focusing electrode increases towards the accelerating electrode.

18. The CRT device of claim 17, wherein an internal wall of the peripheral focusing electrode is parallel to a central axis of the peripheral focusing electrode in a vicinity of the gate electrode.

19. The CRT device of claim 17, wherein an inner wall of the peripheral focusing electrode is slanted in such a manner that the larger a distance from the emitter electrode is, the closer a slanted angle is to being parallel with a main surface of the emitter electrode.

20. The CRT device of claim 1, wherein the accelerating electrode is chamfered on a peripheral focusing electrode side thereof.

21. The CRT device of claim 1, wherein the accelerating electrode is radiused at its periphery on a peripheral focusing electrode side thereof.

22. The CRT device of claim 1, wherein the peripheral focusing electrode is chamfered on an accelerating electrode side thereof.

23. The CRT device of claim 1, wherein the peripheral focusing electrode is radiused at its periphery on an accelerating electrode side thereof.

24. The CRT device of claim 1, wherein an inside diameter of the accelerating electrode is no greater than an inside diameter of the peripheral focusing electrode.

25. The CRT device of claim 1, wherein the cold cathode electron gun further includes:

a focusing electrode disposed on the display screen side in the tube axis direction relative to the accelerating electrode; and an additional focusing electrode that is provided between the accelerating electrode and the focusing electrode, and has a lower voltage than the accelerating electrode.

26. The CRT device of claim 25, wherein the additional focusing electrode is electrically connected with the peripheral focusing electrode.

27. The CRT device of claim 25, wherein the cold cathode electron gun further includes a second additional focusing electrode that is provided between the additional focusing electrode and the focusing electrode and has a higher voltage applied thereto than a voltage applied to the additional focusing electrode.

28. The CRT device of claim 1, wherein $Vf<Vex<<Vg2$ is satisfied where, with respect to the emitter electrode, a voltage applied to the peripheral focusing electrode is Vf, a voltage applied to the gate electrode is Vex, and a voltage applied to the accelerating electrode is Vg2.

29. The CRT device of claim 1, wherein

Vg2 is no smaller than 1 kV and no larger than 4.6 kV, where a voltage applied to the accelerating electrode with respect to the emitter electrode is Vg2.

30. A CRT device comprising:

a cold cathode electron gun that includes (a) a gate electrode, (b) an emitter electrode that has a plurality of protrusions from each of which electrons are emitted, (c) a peripheral focusing electrode that is disposed on the emitter electrode with an insulating layer interposed therebetween, is thicker than the gate electrode, and surrounds the gate electrode, and (d) an accelerating electrode; and a voltage applying unit operable to apply voltages so as to form a crossover by making the voltage of the accelerating electrode higher than the voltages of the gate electrode and the peripheral focusing electrode, wherein each of the plurality of protrusions is at least a predetermined distance apart from the peripheral focusing electrode.

31. The CRT device of claim 30, wherein each of the protrusions is at least 0.01 mm apart from the peripheral focusing electrode.

32. The CRT device of claim 30, wherein the plurality of protrusions are disposed in a rectangular area in a plan view.

33. The CRT device of claim 30, wherein the emitter electrode is made up of at least three partial electrodes that are positioned adjacent to one another in a horizontal direction, the electrons are emitted from all the three partial electrodes, when a central area of a display screen is scanned, and the electrons are emitted from only one of the three partial electrodes that is positioned centrally in the horizontal direction, when an area of the display screen except for the central area thereof is scanned.

* * * * *